US008437649B2

(12) United States Patent
Ochi et al.

(10) Patent No.: US 8,437,649 B2
(45) Date of Patent: May 7, 2013

(54) DEVELOPING DEVICE AND IMAGE FORMING DEVICE

(75) Inventors: Takashi Ochi, Kanagawa (JP); Shigeru Inaba, Kanagawa (JP); Shota Oba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 261 days.

(21) Appl. No.: 12/880,469

(22) Filed: Sep. 13, 2010

(65) Prior Publication Data

US 2011/0222878 A1 Sep. 15, 2011

(30) Foreign Application Priority Data

Mar. 15, 2010 (JP) ..... 2010-057685

(51) Int. Cl.
*G03G 15/00* (2006.01)

(52) U.S. Cl.
USPC ..... 399/44; 399/226; 399/237

(58) Field of Classification Search ..... 399/44, 399/53, 55, 226, 265, 269, 222, 237, 239
See application file for complete search history.

(56) References Cited

U.S. PATENT DOCUMENTS 6,600,890 B2 * 7/2003 Hosoya et al. ..... 399/237
6,735,408 B2 * 5/2004 Yoshino et al. ..... 399/237

FOREIGN PATENT DOCUMENTS

JP A-2008-216552 9/2008

* cited by examiner

*Primary Examiner* — Hoang Ngo
(74) *Attorney, Agent, or Firm* — Oliff & Berridge, PLC

(57) ABSTRACT

A developing device includes: a plurality of developer retaining bodies that retain developer and rotate, and that respectively convey the developer, which is supplied to each of the developer retaining bodies from a developer supply section, to an image bearing body that rotates and bears a latent image; and a speed changing unit that is adapted to change a rotation speed of at least one of the developer retaining bodies excluding a developer retaining body that is furthest downstream side in a direction of rotation of the image bearing body.

21 Claims, 18 Drawing Sheets

DEVELOPING DEVICE AND IMAGE FORMING DEVICE

CROSS-REFERENCE TO RELATED APPLICATION

This application is based on and claims priority under 35 USC 119 from Japanese Patent Application No. 2010-57685 filed on Mar. 15, 2010.

BACKGROUND

1. Technical Field

The present invention relates to a developing device and an image forming device.

2. Related Art

Heretofore, a developing device has been known in which a circumferential speed of a photoreceptor is switchable between two or more levels of circumferential speed within a pre-specified range, and sleeves of a forward developing roller and a backward developing roller of a developing device are turned by respectively separate drive systems and variable speed motors. If the circumferential speed of the sleeve of the forward developing roller is represented by Va (m/s), the circumferential speed of the sleeve of the backward developing roller is represented by Vw (m/s) and the circumferential speed of the photoreceptor is represented by Vp (m/s), the circumferential speeds of the sleeves of the forward developing roller and the backward developing roller are respectively independently changed in accordance with switching of the circumferential speed of the photoreceptor such that Va, Vw and Vp satisfy a pre-specified relationship.

SUMMARY

A developing device relating to a first aspect of the present invention is configured to include: a plurality of developer retaining bodies that retain developer and rotate, and that respectively convey the developer, which is supplied to each of the developer retaining bodies from a developer supply section, to an image bearing body that rotates and bears a latent image; and a speed changing unit that is adapted to change a rotation speed of at least one of the developer retaining bodies excluding a developer retaining body that is furthest downstream side in a direction of rotation of the image bearing body.

BRIEF DESCRIPTION OF THE DRAWINGS

Exemplary embodiments of the present invention will be described in detail based on the following figures, wherein.

DETAILED DESCRIPTION

Herebelow, an example of an exemplary embodiment relating to the present invention is described on the basis of the attached drawings.

Structure of Printer Relating to the Present Exemplary Embodiment

Figure 1:
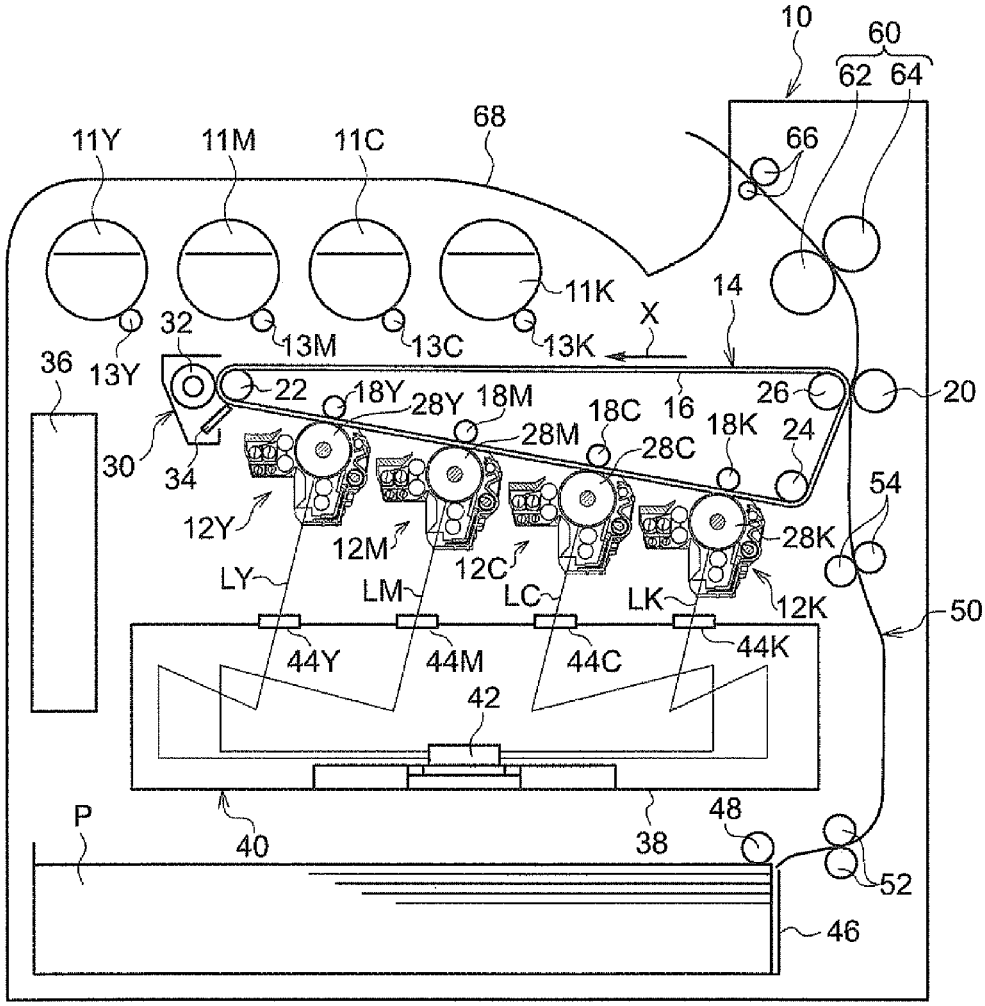
FIG. 1 is an overall structural diagram of a printer relating to a first exemplary embodiment of the present invention.

First, the structure of a printer relating to the present exemplary embodiment is described. FIG. 1 illustrates a printer 10 that serves as an example of an image forming device.

The printer 10 is a digital printer that forms a full-color image or a black-and-white image. An image processing device (not illustrated) is provided inside the printer 10. The image processing device applies image processing to image data that is sent thereto from a personal computer or the like.

As illustrated in FIG. 1, toner cartridges 11Y, 11M, 11C and 11K that accommodate respective toners of yellow (Y), magenta (M), cyan (C) and black (K) are replaceably provided in an upper portion of the printer 10. In the following descriptions, the symbols Y, M, C and K are appended to the reference numerals of members corresponding to the colors yellow, magenta, cyan and black to distinguish therebetween.

One ends of toner supply channels 13Y, 13M, 13C and 13K are connected to the toner cartridges 11Y, 11M, 11C and 11K, respectively. The toner supply channels 13Y, 13M, 13C and 13K are structured by piping and are disposed to be oriented downward along a side face of the printer 10. Intermediate paths thereof are not illustrated.

Four image forming units 12 (12Y, 12M, 12C and 12K), corresponding to the developers of Y, M, C and K, are disposed in a central portion of the printer 10, in an arrangement along a direction diagonally downward to the right in a front view. The developers are two-component developers in which a non-magnetic type of toner and a carrier with magnetism are mixed. The other ends of the toner supply channels 13Y, 13M, 13C and 13K are connected to the image forming units 12Y, 12M, 12C and 12K, respectively, so as to supply the toners of the respective colors to the respective image forming units 12.

A transfer section 14 is provided above the image forming units 12Y, 12M, 12C and 12K. The transfer section 14 includes an intermediate transfer belt 16, first transfer rollers 18Y, 18M, 18C and 18K, and a second transfer roller 20. The intermediate transfer belt 16 serves as an example of an intermediate transfer body. The first transfer rollers 18Y, 18M, 18C and 18K are disposed inside the intermediate transfer belt 16 and serve as examples of four first transfer members that superposingly transfer respective toner images onto the intermediate transfer belt 16. The second transfer roller 20 transfers the toner images superposed on the intermediate transfer belt 16 onto recording paper P.

The intermediate transfer belt 16 is wound with a certain level of tension around a driving roller 22, a tensioning roller 24 and a support roller 26. The driving roller 22 is driven by an unillustrated motor. The tensioning roller 24 regulates the tension of the intermediate transfer belt 16. The support roller 26 is disposed to oppose the second transfer roller 20. The intermediate transfer belt 16 is driven to turn in the direction of arrow X (the anticlockwise direction) in FIG. 1 by the driving roller 22.

The first transfer rollers 18Y, 18M, 18C and 18K are disposed to oppose below-described photoreceptors 28 (28Y, 28M, 28C and 28K) of the image forming units 12Y, 12M, 12C and 12K, respectively, sandwiching the intermediate transfer belt 16. Transfer bias voltages are applied to the first transfer rollers 18Y, 18M, 18C and 18K by a power supply unit (not illustrated). The transfer bias voltages have the opposite polarity from the toner polarity (for example, positive polarity in the present exemplary embodiment). A transfer bias voltage of the opposite polarity to the toner polarity is also applied by the power supply unit to the second transfer roller 20.

A cleaning device 30 is provided at the outer peripheral face of the intermediate transfer belt 16, at a position at which the driving roller 22 is disposed. The cleaning device 30 is provided with a cleaning brush 32 and a cleaning blade 34, and removes residual toner, paper dust and the like on the intermediate transfer belt 16 with the cleaning brush 32 and the cleaning blade 34.

A control unit 36 is provided in the vicinity of a side face of the printer 10 at the opposite side thereof from a conveyance path of the recording paper P. The control unit 36 performs driving control of the respective sections of the printer 10. An exposure unit 40 is provided at the lower side of the image forming units 12. The exposure unit 40 illuminates exposure lights L corresponding to the respective colors (LY, LM, LC and LK) at electrostatically charged surfaces of the photoreceptors 28 and forms electrostatic latent images.

The exposure unit 40 is structured by a single unit common to the four image forming units 12Y, 12M, 12C and 12K. The exposure unit 40 is configured to modulate four semiconductor lasers (not illustrated) in accordance with colorant gradation data of the respective colors and emit the exposure lights LY, LM, LC and LK from the semiconductor lasers in accordance with the gradation data. The exposure unit 40 may be provided separately for each of the image forming units 12.

The exposure unit 40 is enclosed in a cuboid frame 38. Inside the exposure unit 40, an f–θ lens (not illustrated) and a polygon mirror 42 are provided for scanning the exposure lights L in a main scan direction. Glass windows 44Y, 44M, 44C and 44K are provided in the top face of the frame 38 for emitting the four exposure lights LY, LM, LC and LK towards the photoreceptors 28 of the image forming units 12Y, 12M, 12C and 12K.

The exposure lights LY, LM, LC and LK emitted from the semiconductor lasers of the exposure unit 40 are irradiated through the f–θ lens at the polygon mirror 42, and are deflected and scanned by the polygon mirror 42. The exposure lights LY, LM, LC and LK that have been deflected and scanned by the polygon mirror 42 pass through optical systems (not illustrated) constituted with focusing lenses and plural mirrors, and are scanningly exposed onto exposure points on the photoreceptors 28 from diagonally beneath.

A paper supply cassette 46 that accommodates the recording paper P is disposed at the lower side of the exposure unit 40. A paper supply conveyance path 50 is provided that conveys the recording paper P upward in a vertical direction from an end portion of the paper supply cassette 46.

The paper supply conveyance path 50 is provided with a feed roller 48, a roller pair 52 for paper separation and conveyance, and paper leading end positioning rollers 54. The feed roller 48 feeds the recording paper P out from the paper supply cassette 46. The roller pair 52 supplies the recording paper P one sheet at a time. The paper leading end positioning rollers 54 match a timing of movement of an image on the intermediate transfer belt 16 with a timing of conveyance of the recording paper P. The recording paper P that is sequentially fed out from the paper supply cassette 46 by the feed roller 48 passes along the paper supply conveyance path 50, is temporarily conveyed to a second transfer position of the intermediate transfer belt 16 by the paper leading end positioning rollers 54 turning intermittently, and is stopped.

A fixing device 60 is disposed above the second transfer roller 20. The fixing device 60 is provided with a heating roller 62, which is heated, and a pressure roller 64, which is pressed against the heating roller 62. The recording paper P to which the toner image of the respective colors has been transferred by the second transfer roller 20 is subjected to fixing by heat and pressure in a contact portion between the heating roller 62 and the pressure roller 64. The recording paper P is then ejected to an ejection section 68 by ejection rollers 66 provided at the recording paper P conveyance direction downstream side. The ejection rollers 66 serve as an example of an ejection device. The ejection section 68 is provided at a top portion of the printer 10. Meanwhile, the surface of the intermediate transfer belt 16 for which the second transfer processing of the toner image has been completed is cleared of residual toner, paper dust and the like by the cleaning device 30.

Next, the image forming units 12 are described. As an example, the image forming unit 12M is described here. The image forming units 12Y, 12C and 12K corresponding to the other colors have the same structure as the image forming unit 12M, so will not be described. The structural members of the image forming unit 12M are represented with the reference symbol M being omitted.

Figure 2:
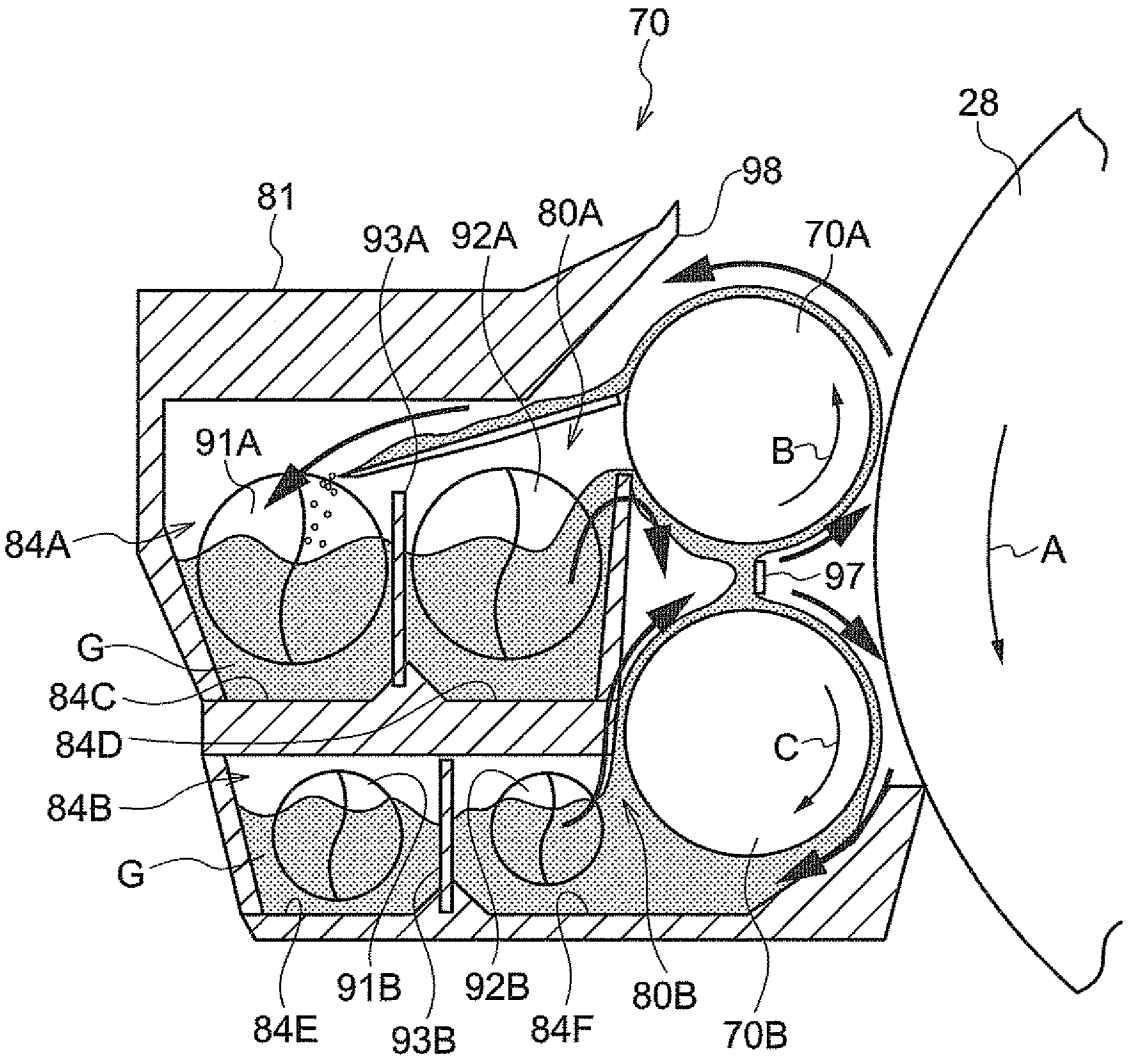
FIG. 2 is a sectional diagram of a developing section of the printer relating to the first exemplary embodiment of the present invention.

As illustrated in FIG. 2, the image forming unit 12 is provided with the photoreceptor 28, which is driven to turn in the direction of arrow A (clockwise). Around the photoreceptor 28, a charging roller (not illustrated), a developing section 70, an erasure lamp (not illustrated) and a cleaning unit (not illustrated) are provided. The charging roller serves as an example of an electrostatic charging device that touches against a surface of the photoreceptor 28 and uniformly charges the photoreceptor 28. The developing section 70 is an example of a developing unit that develops the electrostatic latent image formed on the photoreceptor 28 by the aforementioned exposure light L with a developer (toner) of the respective color. The erasure lamp is an example of a de-electrification device that illuminates light at the surface of the photoreceptor 28 after transfer and de-electrifies the surface. The cleaning unit cleans the surface of the photoreceptor 28 after the de-electrification.

The charging roller (not illustrated), developing section 70, erasure lamp (not illustrated) and cleaning unit (not illustrated) are disposed to oppose the surface of the photoreceptor 28 in this order from the turning direction upstream side to the downstream side.

Next, an image forming process of the printer 10 is described.

As illustrated in FIG. 1, image data that has been subjected to image processing by the image processing device (not illustrated) is converted to colorant gradation data of the four colors yellow (Y), magenta (M), cyan (C) and black (K), and sequentially outputted to the exposure unit 40. From the exposure unit 40, the respective exposure lights L corresponding to the colorant gradation data of the respective colors are emitted, scanning exposure onto the photoreceptors 28 is implemented, and latent images (electrostatic latent images) are formed.

The electrostatic latent images formed on the photoreceptors 28 are manifested and developed as toner images (developer images) of the colors yellow (Y), magenta (M), cyan (C) and black (K) by the developing sections 70, as illustrated in FIG. 1 and FIG. 2. Then, the toner images of the respective colors formed on the photoreceptors 28 of the image forming units 12Y, 12M, 12C and 12K are sequentially superposedly transferred onto the intermediate transfer belt 16 by the four first transfer rollers 18Y, 18M, 18C and 18K.

The toner images of the respective colors that have been superposedly transferred onto the intermediate transfer belt 16 are second-transferred by the second transfer roller 20 onto the recording paper P that has been conveyed thereto. Then, the toner image of the respective colors on the recording paper P is fixed by the fixing device 60, and after fixing the recording paper P is ejected to the ejection section 68.

After the transfer process of the toner image has been completed, the surface of the photoreceptor 28 has residual toner, paper dust and the like removed therefrom by a cleaning unit 76. Residual toner, paper dust and the like on the intermediate transfer belt 16 is removed by the cleaning device 30.

Structure of the Developing Section 70

Next, structure of the developing section 70, which serves as an example of a developing device, is described.

As illustrated in FIG. 2, the developing section 70 is provided with a casing 81, inside which two developer accommodation chambers 80A and 80B that accommodate a developer G are formed.

As illustrated in FIG. 2, agitation and conveyance paths 84A and 84B that agitate (mix) and convey the developer G are formed in the developer accommodation chambers 80A and 80B.

The agitation and conveyance path 84A is partitioned by a partition wall 93A provided standing from a bottom face and two agitation paths are provided, a first agitation path 84C and a second agitation path 84D. A first aperture and a second aperture (not illustrated) are formed at positions at each of two end portions of the partition wall 93A. The first agitation path 84C and the second agitation path 84D communicate through the first aperture and the second aperture.

A toner supply aperture (not illustrated) is formed in the first agitation path 84C. The other end of the aforementioned toner supply channel 13M (see FIG. 1) is connected to this toner supply aperture. Accordingly, toner from the toner cartridge 11M flows down through the toner supply channel 13M and is supplied to the image forming unit 12M (the developing section 70).

A first agitation and conveyance member 91A is disposed in the first agitation path 84C. The first agitation and conveyance member 91A is structured by a first shaft portion (not illustrated), which is turnably supported at the casing 81, and a helical first vane portion (not illustrated) provided around the first shaft portion. Similarly, a second agitation and conveyance member 92A is disposed in the second agitation path 84D. The second agitation and conveyance member 92A is structured by a second shaft portion (not illustrated), which is turnably supported at the casing 81, and a helical second vane portion (not illustrated) provided around the second shaft portion.

When the first shaft portion and the second shaft portion are respectively turned, the developer G in the agitation and conveyance path 84A is mixed with the toner that is supplied, is conveyed while being agitated and mixed both in the first agitation path 84C and in the second agitation path 84D, and is circulated between the first agitation path 84C and the second agitation path 84D.

Similarly to the agitation and conveyance path 84A, the agitation and conveyance path 848 is partitioned by a partition wall 93B provided standing from a bottom face and two agitation paths are provided, a first agitation path 84E and a second agitation path 84F. A first aperture and a second aperture (not illustrated) are formed at positions at each of two end portions of the partition wall 93B. The first agitation path 84E and the second agitation path 84F communicate through the first aperture and the second aperture.

A toner supply aperture (not illustrated) is formed in the first agitation path 84E. The other end of the aforementioned toner supply channel 13M (see FIG. 1) is connected to this toner supply aperture. Accordingly, toner from the toner cartridge 11M flows down through the toner supply channel 13M and is supplied to the image forming unit 12M (the developing section 70).

A first agitation and conveyance member 91B is disposed in the first agitation path 84E. The first agitation and conveyance member 91B is structured by a first shaft portion (not illustrated), which is turnably supported at the casing 81, and a helical first vane portion (not illustrated) provided around the first shaft portion. Similarly, a second agitation and conveyance member 92B is disposed in the second agitation path 84F. The second agitation and conveyance member 92B is structured by a second shaft portion (not illustrated), which is turnably supported at the casing 81, and a helical second vane portion (not illustrated) provided around the second shaft portion.

When the first shaft portion and the second shaft portion are respectively turned, the developer G in the agitation and conveyance path 84B is mixed with the toner that is supplied, is conveyed while being agitated and mixed both in the first agitation path 84E and in the second agitation path 84F, and is circulated between the first agitation path 84E and the second agitation path 84F.

As illustrated in FIG. 2, an aperture portion 98 is formed in a side wall at the photoreceptor 28 side of the casing 81. A developing roller 70A is disposed in the developer accommodation chamber 80A. The developing roller 70A has its axial direction along the length direction of the photoreceptor 28 and turns in the direction of arrow B (the clockwise direction).

A developing roller 70B is disposed in the developer accommodation chamber 80B. The developing roller 70B has its axial direction along the length direction of the photoreceptor 28 and turns in the direction of arrow C (the anticlockwise direction).

A regulation roller 97 is disposed between the developing roller 70A and the developing roller 70B.

The regulation roller 97 is disposed at a spacing from each of an outer peripheral face of the developing roller 70A and an outer peripheral face of the developing roller 70B. The regulation roller 97 regulates amounts of developer passing along the surfaces of the developing rollers 70A and 70B, and forms developer layers of a pre-decided thickness on the surfaces of the developing rollers 70A and 70B.

The developing rollers 70A and 70B are disposed to oppose the outer peripheral surface of the photoreceptor 28. The developing rollers 70A and 70B are structured by magnetic rolls (not illustrated), which are fixed to the developer accommodation chambers 80A and 80B, and hollow circular tube-shaped developing sleeves (not illustrated) that serve as tubular rotating bodies which are provided to be turnable around the outside of the magnetic rolls. A developing bias voltage is applied to the developing rollers 70A and 70B from the power supply unit (not illustrated), a developing electric field is formed between the developing rollers 70A and 70B, and the photoreceptor 28, and toner in the developer G transfers to the latent image on the photoreceptor 28 during development.

The two developing rollers 70A and 70B receive developer from the upper and lower developer accommodation chambers 80A and 80B, thereafter retain the developer in the form of thin layers, and implement development. After development, the developing roller 70A returns developer to the first agitation path 84C or the second agitation path 84D, and the developing roller 70B returns developer to the first agitation path 84E or the second agitation path 84F.

The turning directions of the developing rollers may be any directions as long as each of the upper and lower developing rollers receives developer without the developer having passed along the other developing roller and each returns the developer to an agitation path separately, as described above.

Figure 3:
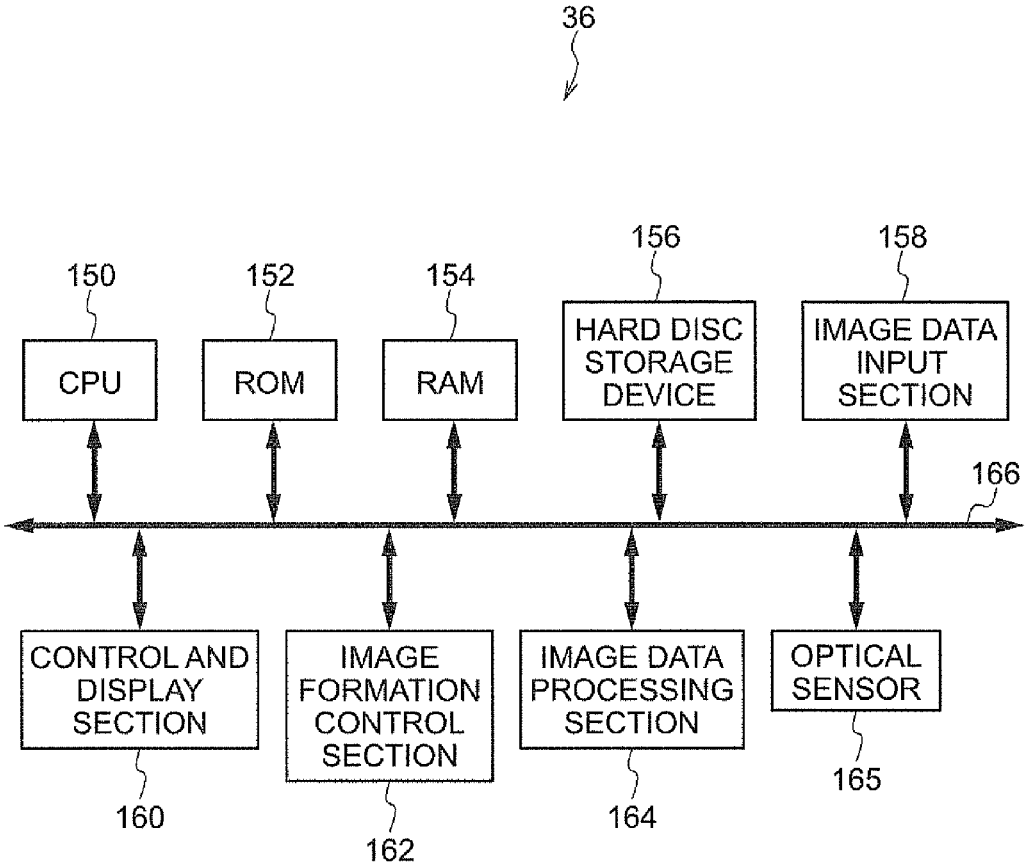
FIG. 3 is a block diagram illustrating structure of a control unit relating to the first exemplary embodiment of the present invention.

FIG. 3 is a diagram illustrating structure of the control unit 36.

The control unit 36 is provided with a CPU 150 that administers overall control of the printer 10. The CPU 150 is connected to each of a ROM 152, a RAM 154, a hard disc storage device 156, an image data input section 158, a control and display section 160, an image formation control section 162, an image data processing section 164 and an optical sensor 165, via a bus 166 which is a control bus, a data bus or the like.

The ROM 152 stores control programs for controlling the printer 10. The RAM 154 is used as a workspace for processing various kinds of data and the like. The hard disc storage device 156 stores image data, various kinds of data relating to image formation and the like.

The image data input section 158 receives inputs of image data from personal computers and the like. The inputted image data is sent to the hard disc storage device 156.

The control and display section 160 is configured to include a touch panel in which control functions and display functions are integrated, and also control buttons for a user to perform various controls with. The control and display section 160 receives controls for starting image formation on the recording paper P and the like, and reports control states of the printer 10 and the like to the user.

The image formation control section 162 controls driving of the image forming units 12Y, 12M, 12C and 12K and driving of motors of the various rollers and the like (not illustrated) in order to form images on the recording paper P on the basis of image data.

The image data processing section 164 performs image processing on the image data stored in the hard disc storage device 156, such as conversion to colorant gradation data of the respective colors and the like.

The optical sensor 165 is disposed over the intermediate transfer belt 16 to downstream relative to the image forming units 12Y, 12M, 12C and 12K and upstream relative to the second transfer roller 20, and detects toner densities of the toner images transferred onto the intermediate transfer belt 16.

Figure 4:
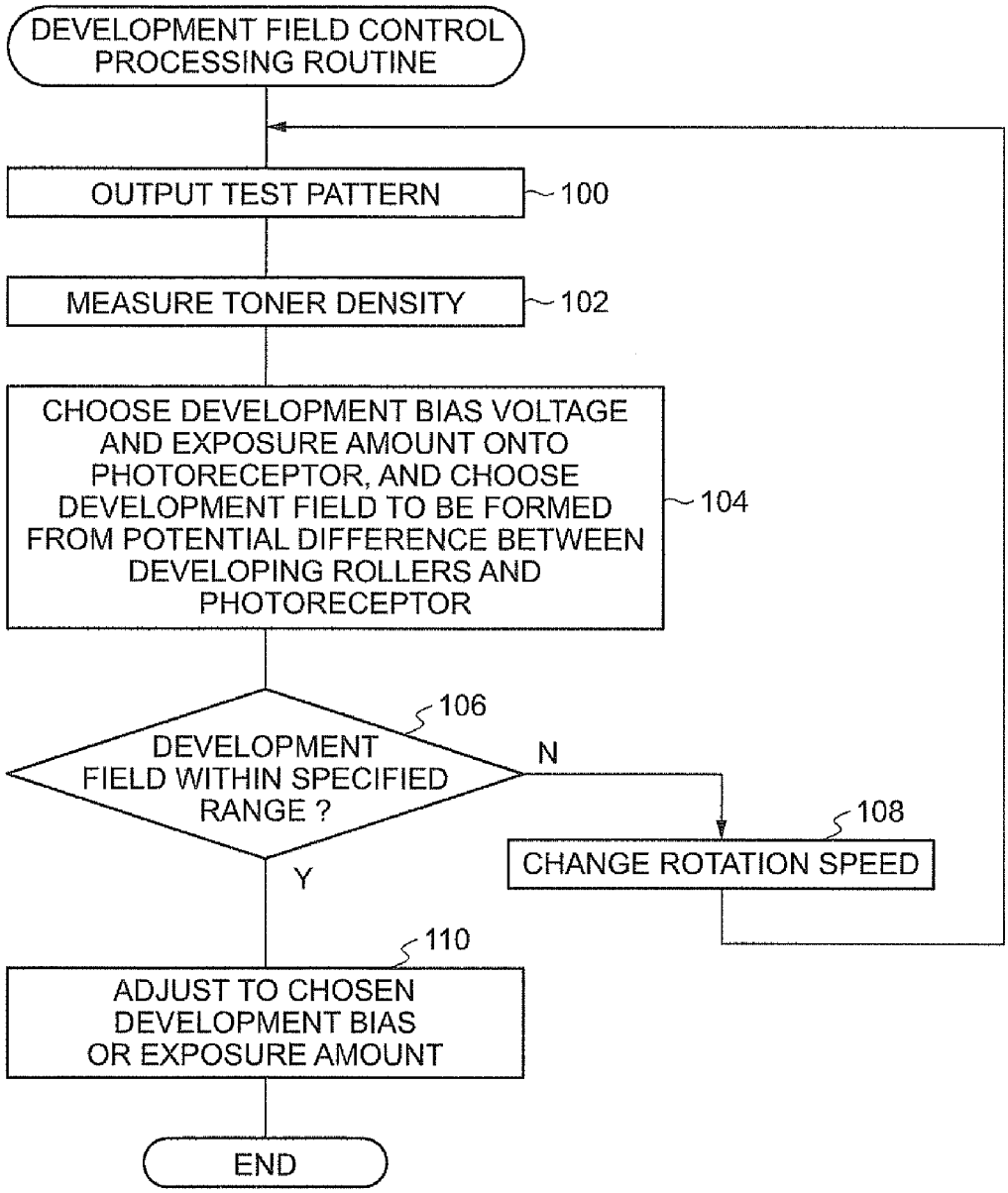
FIG. 4 is a flowchart illustrating details of a development field control processing routine of the control unit relating to the first exemplary embodiment of the present invention.

Next, a development field control processing routine of the first exemplary embodiment is described with reference to FIG. 4. For example, when an instruction signal instructing an adjustment of the development field is inputted between one image forming process and another image forming process, a development field adjustment program stored in the ROM 152 is executed by the CPU 150. Accordingly, the present routine starts for each ink color of cyan, magenta and yellow. In the following description, a case of performing development field adjustment for cyan is described.

First, in step 100, a cyan test pattern for detecting toner density is generated, and a toner image in which the cyan test pattern is developed is formed on the intermediate transfer belt 16 by the image formation control section 162. In step 102, when the developed toner image of the test pattern is conveyed to a reading position of the optical sensor 165, the whole of the toner image of the test pattern is read by the optical sensor 165, and a cyan toner density is measured from reading data based on the test pattern.

Then, in step 104, the developing bias voltage applied to the developing rollers 70A and 70B or an exposure amount onto the photoreceptor 28, or both, is chosen on the basis of the toner densities measured in step 102, and a development field to be formed between the developing rollers 70A and 70B, and the photoreceptor 28 is chosen. For example, if the measured toner density is not within a pre-specified density range, the developing bias voltage and exposure amount are chosen in order to put the toner density within the pre-specified density range.

Then, in step 106, it is determined whether or not the development field chosen in step 104 is within a pre-specified development field range. If it is determined that the development field is outside the pre-specified range, then, in step 108, control is performed so as to change a rotation speed of the developing roller 70A that is disposed at the upstream side of the direction of turning of the photoreceptor 28, and control returns to step 100. If the chosen development field is larger than a maximum value of the pre-specified development field range, the rotation speed of the developing roller 70A is changed so as to increase. For example, if a plural number of levels of rotation speed have been specified beforehand, control is performed to step up the rotation speed. On the other hand, if the chosen development field is smaller than a minimum value of the pre-specified development field range, the rotation speed of the developing roller 70A is changed so as to decrease. For example, if a plural number of levels of rotation speed have been specified beforehand, control is performed to step down the rotation speed.

Alternatively, if the development field is determined to be within the pre-specified electric field range in step 106, then, in step 110, the developing bias voltage applied to the developing rollers 70A and 70B and/or the exposure amount onto the photoreceptor 28 is adjusted to the developing bias voltage and/or exposure amount chosen in step 104, and the development field control processing routine ends. Thus, the developing bias voltage or exposure amount is adjusted such that the development field is formed in accordance with the toner density.

Figure 5:
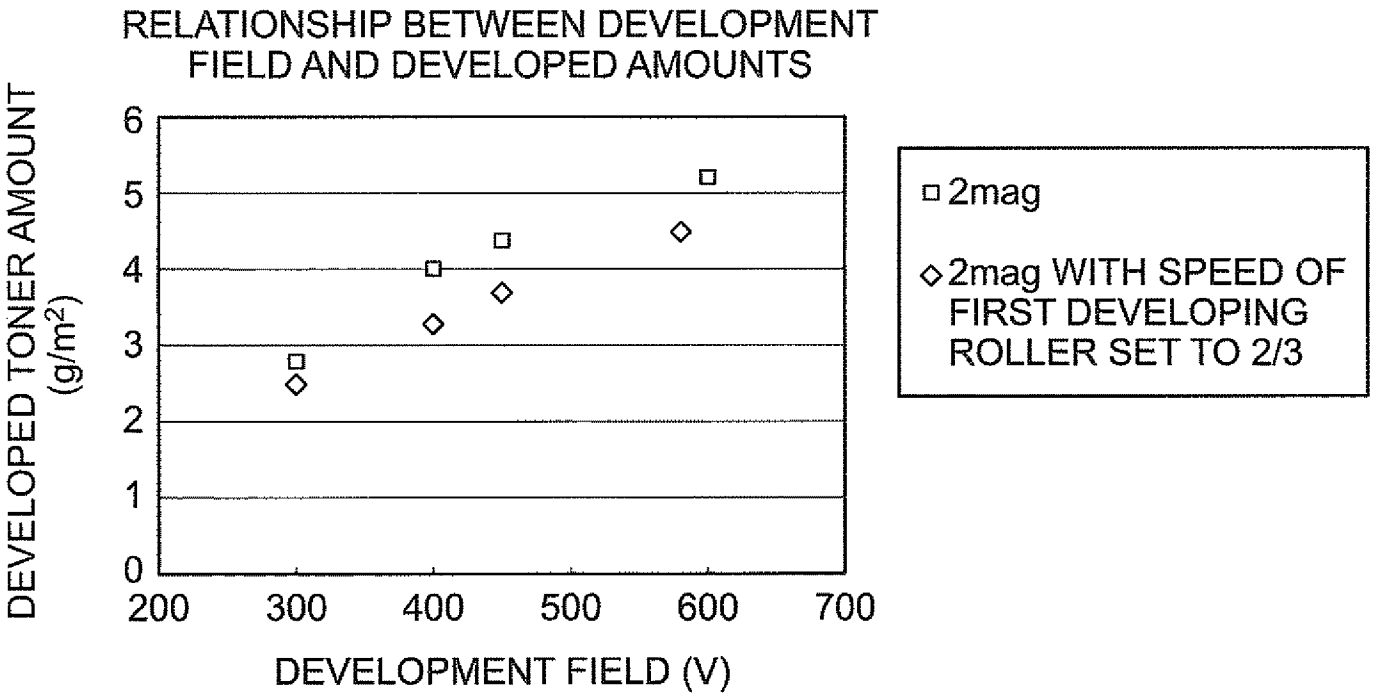
FIG. 5 is a graph illustrating a relationship between the development field and developed toner amounts.

Now, as illustrated in FIG. 5, it can be seen that when development is performed with two developing rollers, an amount of toner that is developed changes and a development capacity changes if the rotation speed of the first developing roller, which is the developing roller disposed at the upstream side of the turning direction of the photoreceptor, is decreased.

Figure 6:
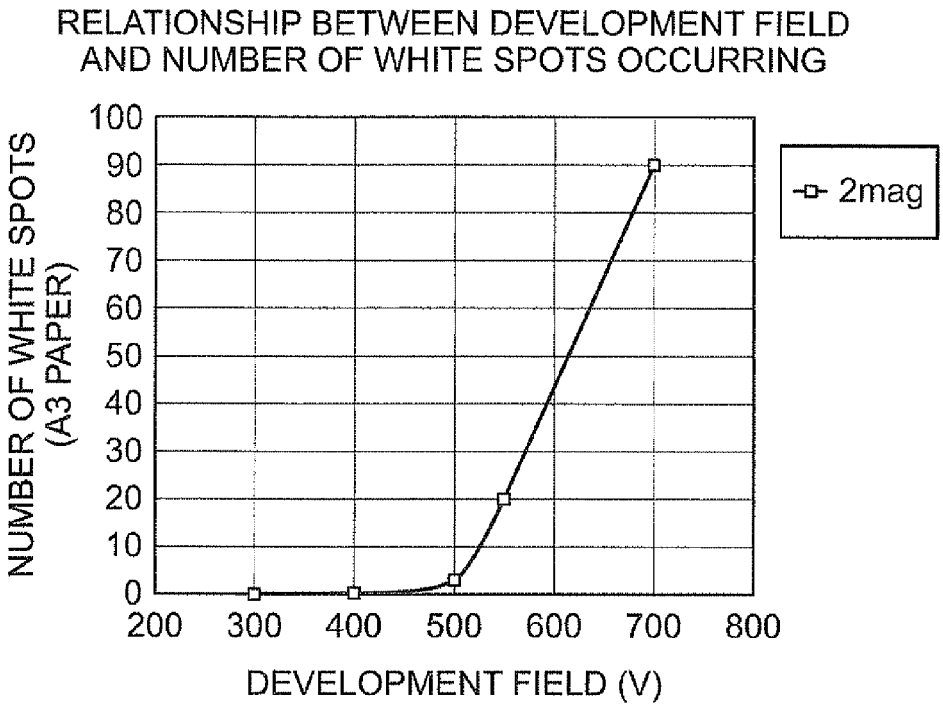
FIG. 6 is a graph illustrating a relationship between the development field and numbers of white spots.

Further, development fields that prevent reductions in image quality are illustrated. Ordinarily, if a development field is too high, defects in the form of white spots occur, and if a development field is too low, there are defects that mean it is not possible to strike a balance between fine lines and fogging and there are problems with unevennesses in density tending to occur. FIG. 6 is a diagram illustrating the relationship between numbers of white spots and development fields. It can be seen that white spots are more likely to occur when the development field is large.

Figure 7:
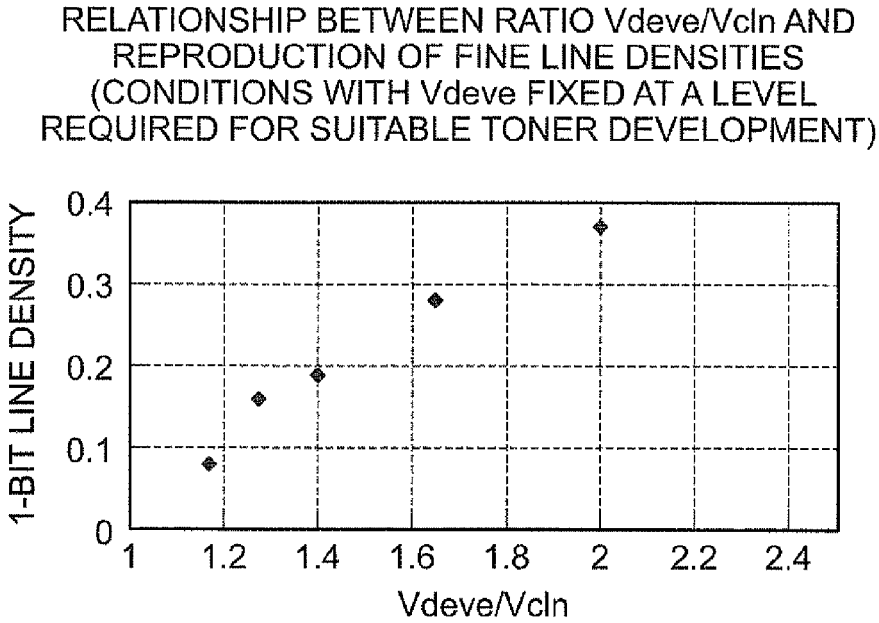
FIG. 7 is a graph illustrating a relationship between a ratio of the development field to a cleaning field and fine line density.
Figure 8:
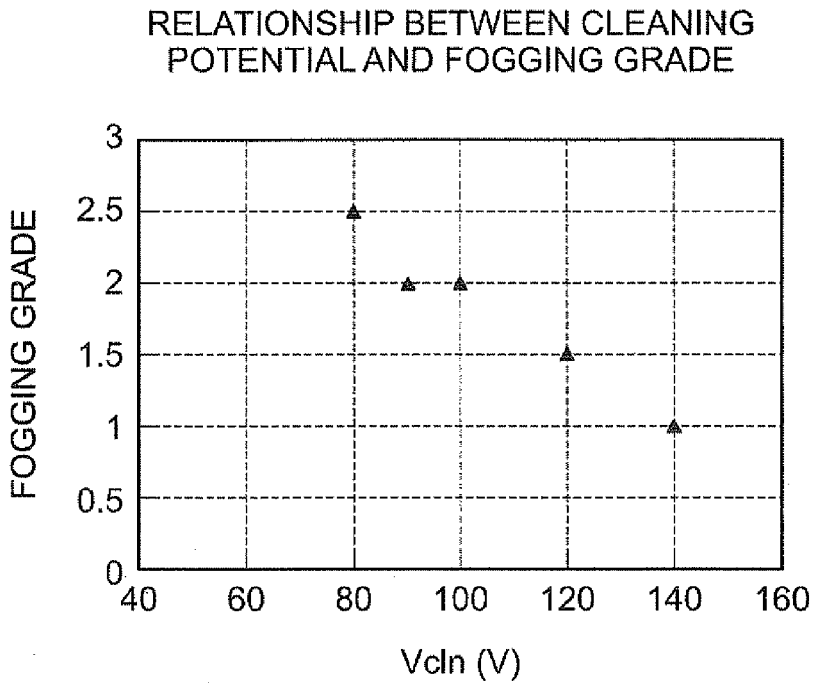
FIG. 8 is a graph illustrating a relationship between the cleaning field and a fogging grade.
Figure 9:
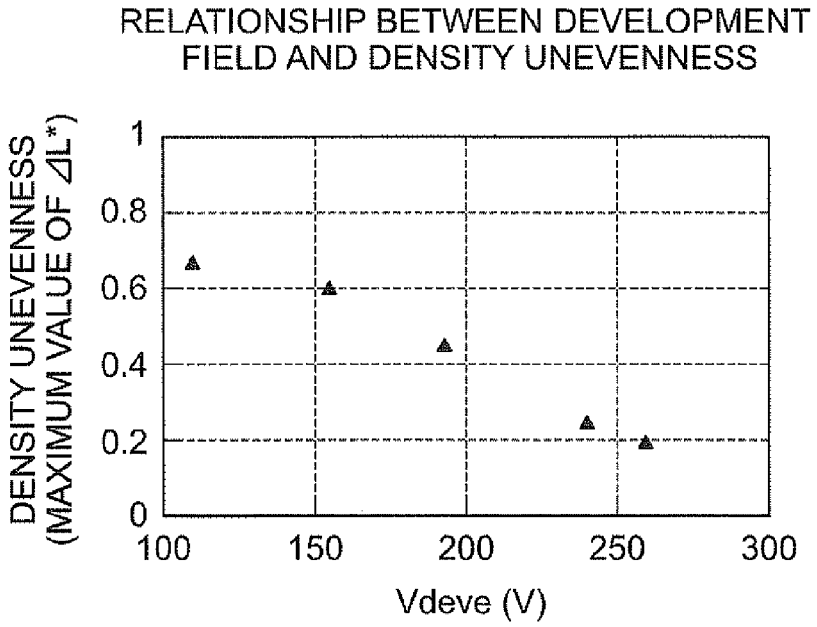
FIG. 9 is a graph illustrating a relationship between the development field and a degree of density unevenness.

FIG. 9 is a graph illustrating a relationship between development fields and density mottling (unevenness within images). It can be seen that a degree of density unevenness is larger when the development field is too low. FIG. 7 is a graph illustrating the relationship between a ratio of the development field (Vdeve) to the cleaning electric field (Vcln) and density reproduction quality of fine lines. It can be seen therefrom that fine lines cannot be reproduced if the ratio Vdeve/Vcln is not at least a certain value. If the development field (Vdeve) is made smaller, the cleaning electric field (Vcln) must also be made smaller in order to maintain the ratio Vdeve/Vcln at least the certain value. However, according to the relationship between the cleaning electric field and fogging illustrated in FIG. 8, if the cleaning electric field (Vcln) becomes too small, there is a "fogging" effect in which toner is developed at regions that should not be developed. Thus, it can be seen that it is not possible to strike a balance between reproduction of fine lines and preventing fogging if the development field is too small.

Given the above, because problems arise if the development field is either too high or too low, it is desirable to keep the development field within a required development field range in order to prevent a drop in image quality.

In the development field control processing routine described above, the rotation speed of the developing roller changes if the development field according to the developing bias voltage or exposure amount chosen in accordance with the toner density is outside a pre-specified range, and the development capacity changes. Thus, the development field is kept within the pre-specified development field range and deteriorations in image quality are prevented.

Figure 10:
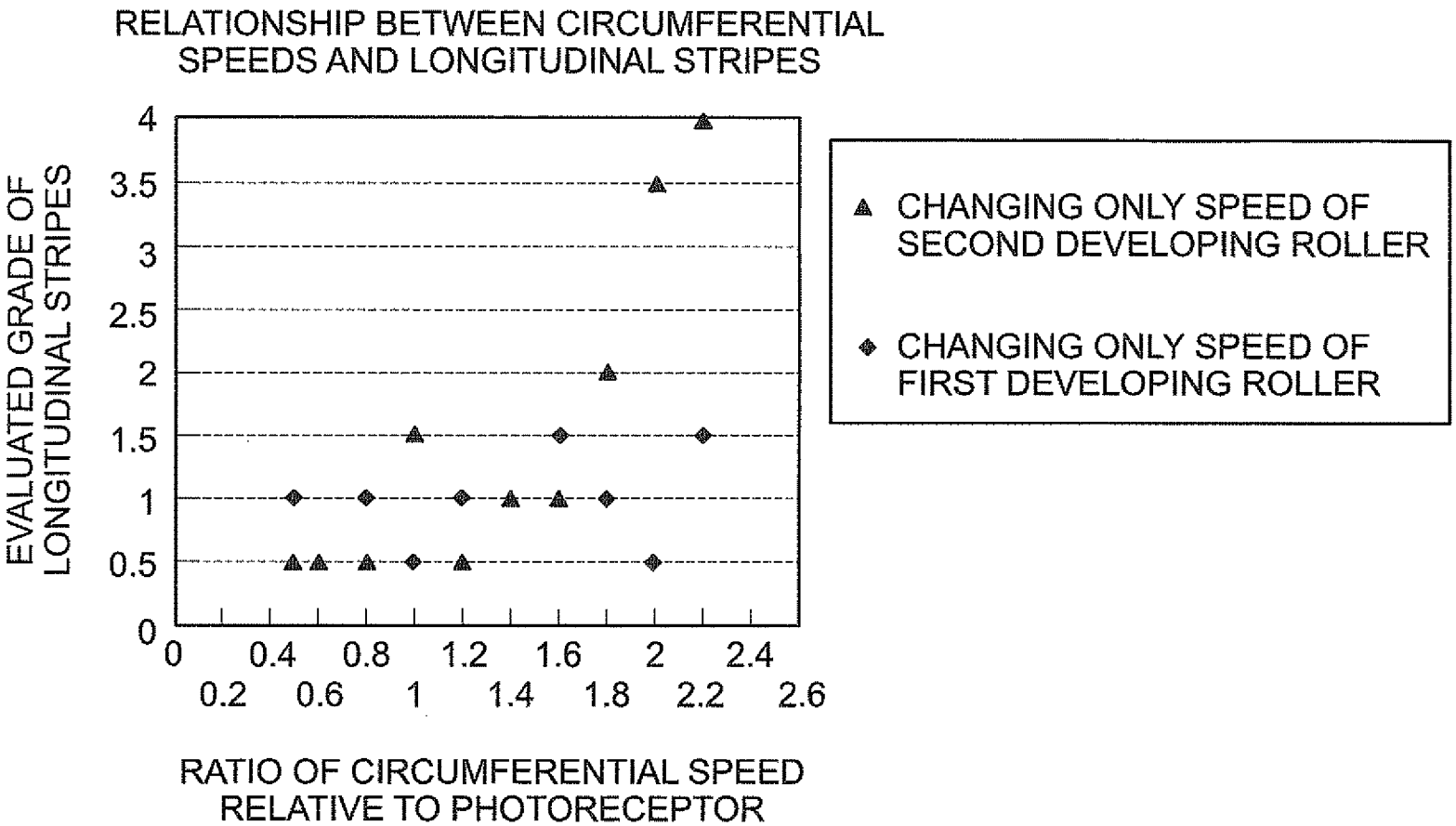
FIG. 10 is a graph illustrating a relationship between circumferential speeds of first and second developing rollers and longitudinal stripes.
Figure 11:
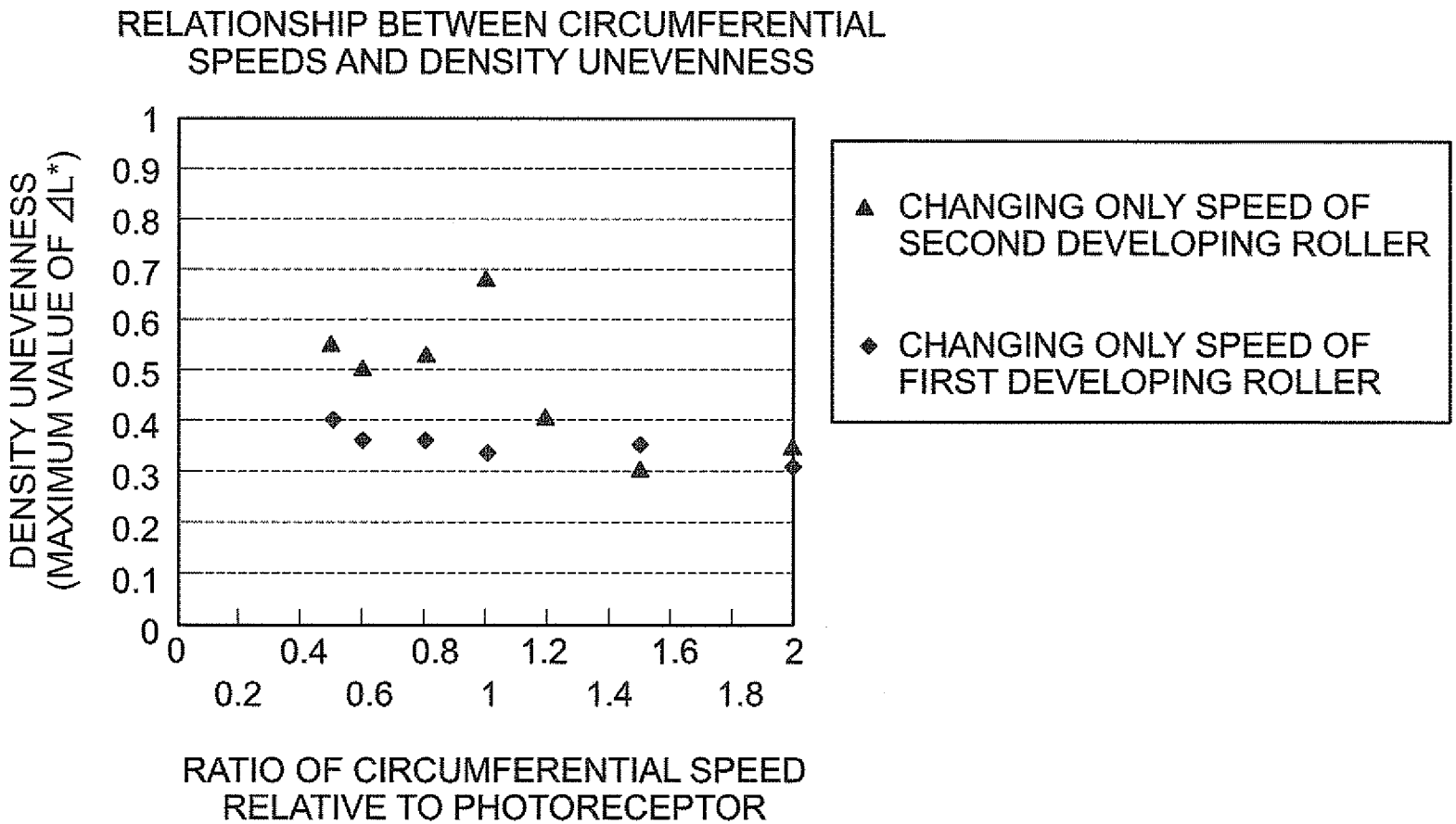
FIG. 11 is a graph illustrating a relationship between circumferential speeds of first and second developing rollers and density unevenness.

Now a reason for changing the peripheral speed of the first developing roller to keep the development field within the pre-specified range is described. With a structure in which the peripheral speed of the second developing roller changes, a range of control of the development field is wider, but image quality changes when the circumferential speed of the second developing roller is changed, so this is not desirable. For example, if the circumferential speed of the second developing roller were to be made faster, as illustrated in FIG. 10, mottling in the form of longitudinal stripes in an image would start to appear. On the other hand, if the circumferential speed of the second developing roller were to be made slower, as illustrated in FIG. 11, density mottling would occur. These relationships are illustrated in FIG. 10 and FIG. 11, respectively.

As described hereabove, according to the printer relating to the first exemplary embodiment, the rotation speed of the developing roller disposed at the upstream side of the turning direction of the photoreceptor changes in accordance with detected toner densities and a development capacity according to the plural developing rollers is adjusted, with a development field with which deteriorations of image quality do not occur being maintained rather than the development field being put outside a development field range in which deteriorations of image quality do not occur.

In the exemplary embodiment described hereabove, an example is described of a case in which, if the development field chosen on the basis of a detected toner density is outside a pre-specified development field range, the rotation speed of the developing roller disposed at the upstream side of the turning direction of the photoreceptor is changed. However, the present invention is not to be limited thus. For example, the rotation speed of the developing roller disposed at the upstream side of the turning direction of the photoreceptor may be changed when a detected toner density is outside a density range that is specified in advance as a range in which deteriorations in image quality do not occur. For example, if a detected toner density is higher than the maximum value of the pre-specified density range, the rotation speed of the developing roller disposed at the upstream side of the turning direction of the photoreceptor may be changed so as to slow down in order to reduce development capacity, and if a detected toner density is lower than the minimum value of the pre-specified density range, the rotation speed of the developing roller disposed at the upstream side of the turning direction of the photoreceptor may be changed so as to speed up in order to raise development capacity.

Next, a second exemplary embodiment is described. Portions with the same structure as in the first exemplary embodiment are assigned the same reference numerals and are not described.

The second exemplary embodiment differs from the first exemplary embodiment in that the developing bias voltage applied to the developing rollers is chosen in accordance with humidity.

Figure 12:
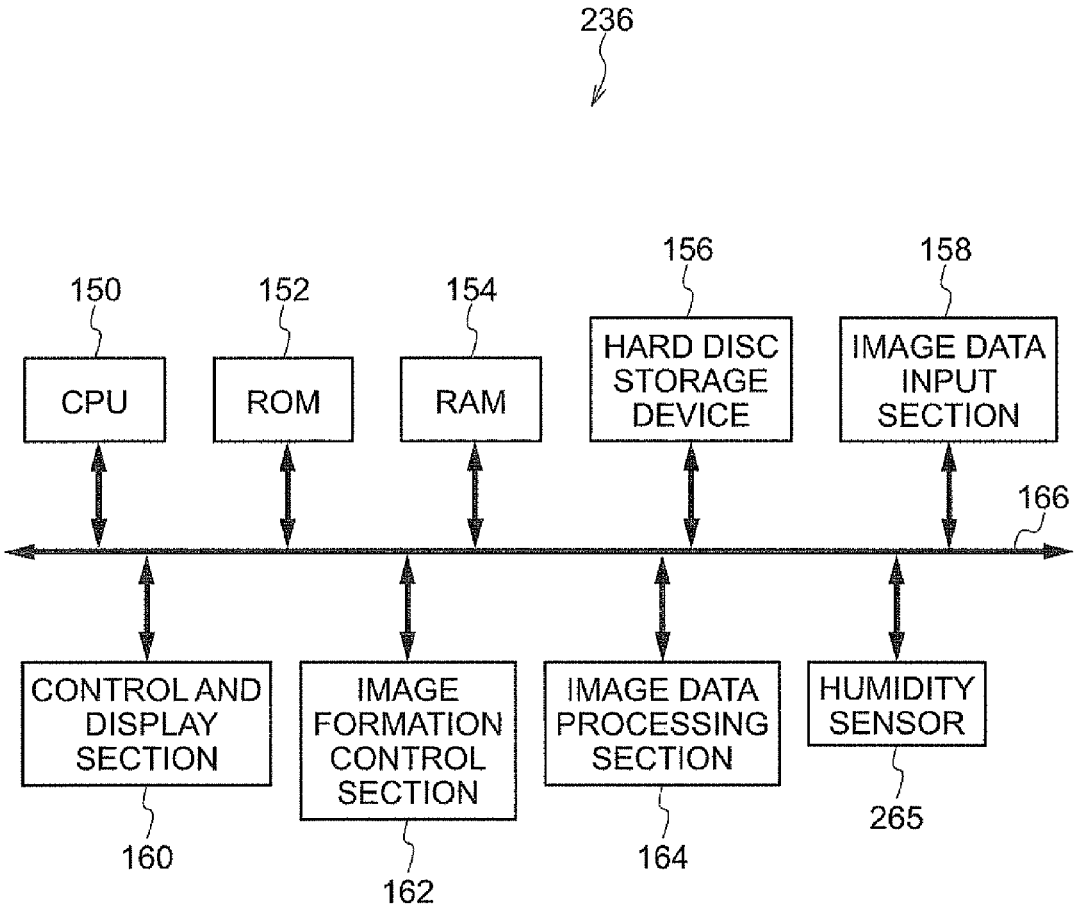
FIG. 12 is a block diagram illustrating structure of a control unit relating to a second exemplary embodiment of the present invention.

As illustrated in FIG. 12, in a control unit 236 of a printer relating to the second exemplary embodiment, the CPU 150 is connected to each of the ROM 152, the RAM 154, the hard disc storage device 156, the image data input section 158, the control and display section 160, the image formation control section 162, the image data processing section 164 and a humidity sensor 265, via the bus 166.

The humidity sensor 265 is provided inside the printer 10 and detects humidity.

Other structures of the printer relating to the second exemplary embodiment are the same as in the first exemplary embodiment, so will not be described.

Figure 13:
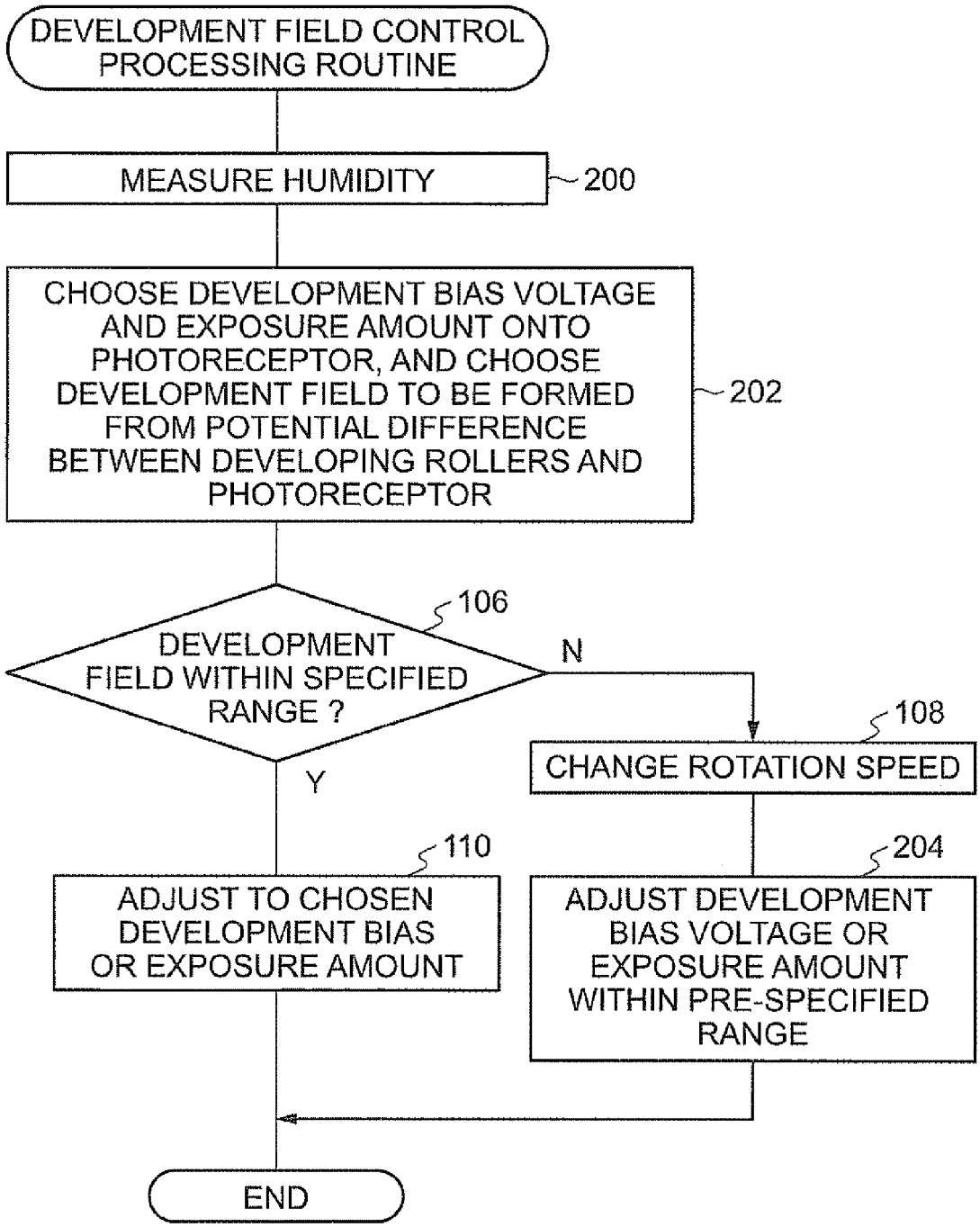
FIG. 13 is a flowchart illustrating details of a development field control processing routine of the control unit relating to the second exemplary embodiment of the present invention.

Next, a development field control processing routine relating to the second exemplary embodiment is described with reference to FIG. 13. In the following description, a case of performing development field adjustment for cyan is described.

First, in step 200, a humidity is detected by the humidity sensor 265. Then, in step 202, the developing bias voltage applied to the developing rollers 70A and 70B or the exposure amount onto the photoreceptor 28, or both, is chosen on the basis of the humidity detected in step 200, and the development field formed between the developing rollers 70A and 70B, and the photoreceptor 28 is chosen. For example, when the detected humidity is higher, a higher developing bias voltage or a larger exposure amount is chosen.

Then, in step 106, it is determined whether or not the development field chosen in step 202 is within a pre-specified development field range. If it is determined that the development field is outside the pre-specified range, then, in step 108, control is performed so as to change the rotation speed of the developing roller 70A that is disposed at the upstream side of the direction of turning of the photoreceptor 28. If the chosen development field is larger than the maximum value of the pre-specified development field range, the rotation speed of the developing roller 70A is changed so as to increase. On the other hand, if the chosen development field is smaller than the minimum value of the pre-specified development field range, the rotation speed of the developing roller 70A is changed so as to decrease.

In step 204, the developing bias voltage applied to the developing rollers 70A and 70B or the exposure amount onto the photoreceptor 28 is adjusted within a pre-specified voltage range or pre-specified exposure amount range corresponding to the pre-specified development field range, and the development field control processing routine ends. For example, if the developing bias voltage chosen in step 202 is a developing bias voltage corresponding to a development field that is larger than the maximum value of the pre-specified development field, the developing bias voltage to be applied to the developing rollers 70A and 70B is adjusted to the maximum value of the pre-specified voltage range. Further, if the developing bias voltage chosen in step 202 is a developing bias voltage corresponding to a development field that is smaller than the minimum value of the pre-specified development field, the developing bias voltage to be applied to the developing rollers 70A and 70B is adjusted to the minimum value of the pre-specified voltage range.

Alternatively, if the development field is determined to be within the pre-specified electric field range in step 106, then, in step 110, the developing bias voltage applied to the developing rollers 70A and 70B or the exposure amount onto the photoreceptor 28 is adjusted to the developing bias voltage or exposure amount onto the photoreceptor 28 chosen in step 202, and the development field control processing routine ends. Thus, the developing bias voltage or exposure amount is adjusted such that the development field is formed in accordance with the humidity.

As described hereabove, according to the printer relating to the second exemplary embodiment, the rotation speed of the developing roller disposed at the upstream side of the turning direction of the photoreceptor changes in accordance with detected humidities and a development capacity according to the plural developing rollers is adjusted, with a development field with which deteriorations of image quality do not occur being maintained rather than the development field being put outside the development field range in which deteriorations of image quality do not occur.

In the exemplary embodiment described hereabove, an example is described of a case in which, if the development field chosen on the basis of detected humidity is outside a pre-specified development field range, the rotation speed of the developing roller disposed at the upstream side of the turning direction of the photoreceptor changes. However, the present invention is not to be limited thus. For example, the rotation speed of the developing roller disposed at the upstream side of the turning direction of the photoreceptor may be changed when a detected humidity is outside a humidity range that is specified in advance as a range in which deteriorations in image quality do not occur. For example, if a detected humidity is higher than the maximum value of the pre-specified humidity range, because the development field is smaller due to the humidity, the rotation speed of the developing roller disposed at the upstream side of the turning direction of the photoreceptor may be changed so as to speed up in order to raise development capacity, and if a detected humidity is lower than the minimum value of the pre-specified humidity range, because the development field is larger due to the humidity, the rotation speed of the developing roller disposed at the upstream side of the turning direction of the photoreceptor may be changed so as to slow down in order to reduce development capacity.

Next, a third exemplary embodiment is described. A printer relating to the third exemplary embodiment has the same structure as in the first exemplary embodiment, so the same reference numerals are assigned and descriptions are not given.

The third exemplary embodiment differs from the first exemplary embodiment in that the developing bias voltage applied to the developing rollers is chosen in accordance with a number of white spots that are detected.

Figure 14:
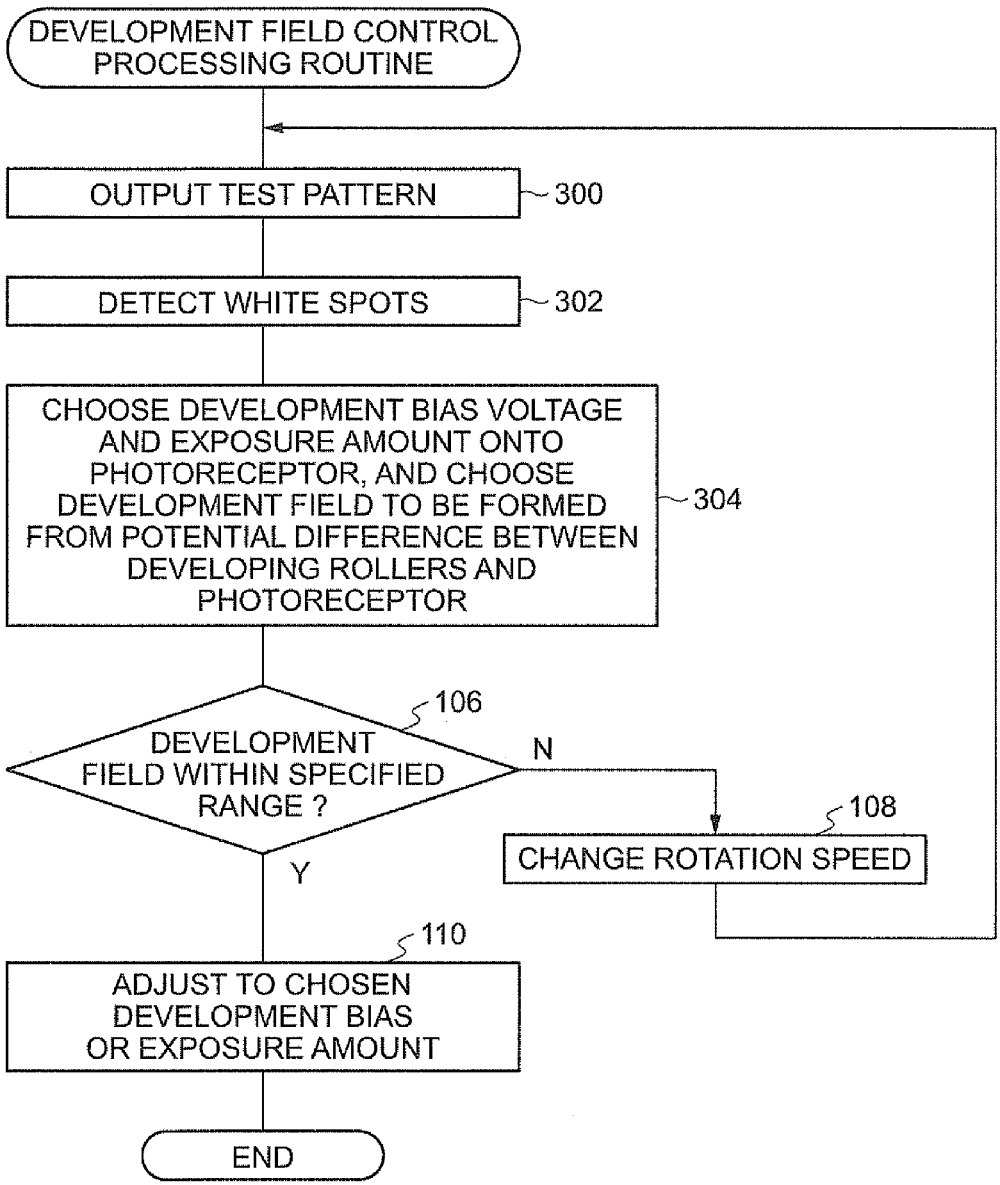
FIG. 14 is a flowchart illustrating details of a development field control processing routine of a control unit relating to a third exemplary embodiment of the present invention.

A development field control processing routine relating to the third exemplary embodiment is described with reference to FIG. 14. In the following description, a case of performing development field adjustment for cyan is described.

First, in step 300, a cyan test pattern for detecting white spots is generated, and a toner image in which the cyan test pattern is developed is formed on the intermediate transfer belt 16 by the image formation control section 162. In step 302, when the developed toner image of the test pattern is conveyed to the reading position of the optical sensor 165, the whole of the toner image of the test pattern is read by the optical sensor 165, and white spots are detected from reading data based on the test pattern.

Then, in step 304, the developing bias voltage applied to the developing rollers 70A and 70B or the exposure amount onto the photoreceptor 28, or both, is chosen on the basis of the number of white spots detected in step 302, and a development field to be formed between the developing rollers 70A and 70B, and the photoreceptor 28 is chosen. For example, if a detected number of white spots is greater than a pre-specified fixed value (e.g., four on an A3 size area), the developing bias voltage and exposure amount are chosen in order to reduce the number of white spots.

Then, in step 106, it is determined whether or not the development field chosen in step 304 is within a pre-specified development field range. If it is determined that the development field is outside the pre-specified development field range, then, in step 108, control is performed so as to change the rotation speed of the developing roller 70A, and control returns to step 300. If the chosen development field is larger than the maximum value of the pre-specified development field range, the rotation speed of the developing roller 70A is changed so as to increase. On the other hand, if the chosen development field is smaller than the minimum value of the pre-specified development field range, the rotation speed of the developing roller 70A is changed so as to decrease.

Alternatively, if the development field is determined to be within the pre-specified development field range in step 106, then, in step 110, the developing bias voltage applied to the developing rollers 70A and 70B or the exposure amount onto the photoreceptor 28 is adjusted to the developing bias voltage or exposure amount onto the photoreceptor 28 chosen in step 304, and the development field control processing routine ends. Thus, the developing bias voltage or exposure amount is adjusted such that the development field is formed in accordance with results of detection of white spots.

As described hereabove, according to the printer relating to the third exemplary embodiment, the rotation speed of the developing roller disposed at the upstream side of the turning direction of the photoreceptor changes in accordance with results of detection of white spots and a development capacity according to the plural developing rollers is adjusted, with a development field with which deteriorations of image quality do not occur being maintained rather than the development field being put outside the development field range in which deteriorations of image quality do not occur.

In the exemplary embodiment described hereabove, an example is described of a case in which, if the development field chosen on the basis of white spot detection results is outside a pre-specified development field range, the rotation speed of the developing roller disposed at the upstream side of the turning direction of the photoreceptor is changed. However, the present invention is not to be limited thus. For example, the rotation speed of the developing roller disposed at the upstream side of the turning direction of the photoreceptor may be changed when a detected number of white spots is outside a range that is specified in advance as a range in which deteriorations in image quality do not occur. For example, if a detected number of white spots is larger than the maximum value of the pre-specified range, because it is determined that the development field is large, the rotation speed of the developing roller disposed at the upstream side of the turning direction of the photoreceptor may be changed so as to speed up.

Next, a fourth exemplary embodiment is described. A printer relating to the fourth exemplary embodiment has the same structure as in the first exemplary embodiment, so the same reference numerals are assigned and descriptions are not given.

The fourth exemplary embodiment differs from the first exemplary embodiment in that the developing bias voltage applied to the developing rollers is chosen in accordance with a measured density of fine lines.

Figure 15:
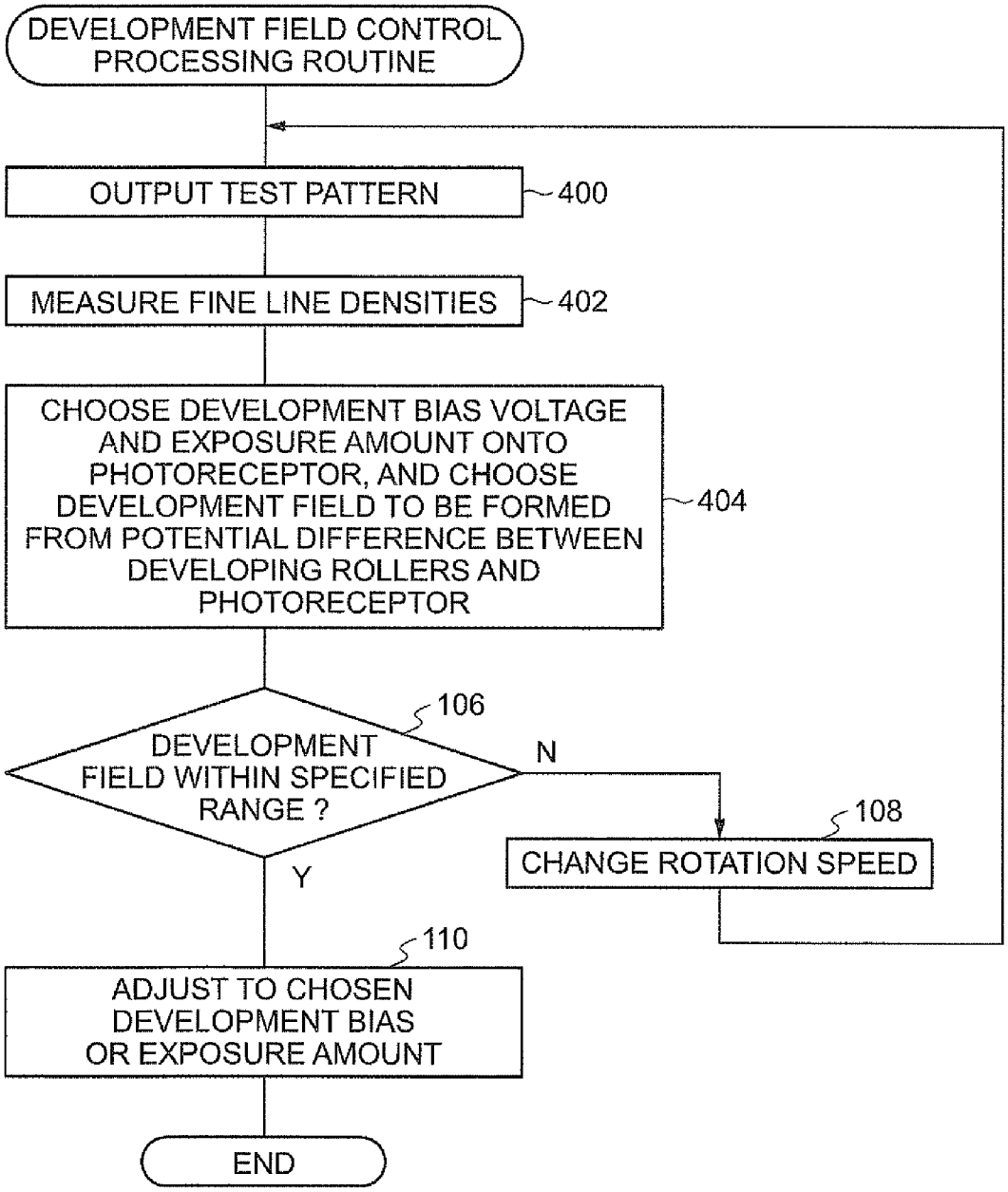
FIG. 15 is a flowchart illustrating details of a development field control processing routine of a control unit relating to a fourth exemplary embodiment of the present invention.

A development field control processing routine relating to the fourth exemplary embodiment is described with reference to FIG. 15. In the following description, a case of performing development field adjustment for cyan is described.

First, in step 400, a cyan test pattern for measuring one-bit fine line densities is generated, and a toner image in which the cyan test pattern is developed is formed on the intermediate transfer belt 16 by the image formation control section 162. In step 402, when the developed toner image of the test pattern is conveyed to the reading position of the optical sensor 165, the whole of the test pattern toner image is read by the optical sensor 165, and fine line density is measured from reading data based on the test pattern.

Then, in step 404, the developing bias voltage applied to the developing rollers 70A and 70B or the exposure amount onto the photoreceptor 28, or both, is chosen on the basis of the fine line density detected in step 402, and a development field to be formed between the developing rollers 70A and 70B, and the photoreceptor 28 is chosen. For example, if a detected fine line density is not within a pre-specified density range, the developing bias voltage and exposure amount are chosen in order to put the fine line density into the pre-specified density range.

Then, in step 106, it is determined whether or not the development field chosen in step 404 is within a pre-specified development field range. If it is determined that the development field is outside the pre-specified development field range, then, in step 108, control is performed so as to change the rotation speed of the developing roller 70A, and control returns to step 400. If the chosen development field is larger than the maximum value of the pre-specified development field range, the rotation speed of the developing roller 70A is changed so as to increase. On the other hand, if the chosen development field is smaller than the minimum value of the pre-specified development field range, the rotation speed of the developing roller 70A is changed so as to decrease.

Alternatively, if the development field is determined to be within the pre-specified development field range in step 106, then, in step 110, the developing bias voltage applied to the developing rollers 70A and 70B or the exposure amount onto the photoreceptor 28 is adjusted to the developing bias voltage or exposure amount onto the photoreceptor 28 chosen in step 404, and the development field control processing routine ends. Thus, the developing bias voltage or exposure amount is adjusted such that the development field is formed in accordance with results of detection of fine line density.

As described hereabove, according to the printer relating to the fourth exemplary embodiment, the rotation speed of the developing roller disposed at the upstream side of the turning direction of the photoreceptor changes in accordance with results of detection of fine line densities and a development capacity according to the plural developing rollers is adjusted, with a development field with which deteriorations of image quality do not occur being maintained rather than the development field being put outside the development field range in which deteriorations of image quality do not occur.

In the exemplary embodiment described hereabove, an example is described of a case in which, if the development field chosen on the basis of detected fine line density is outside a pre-specified development field range, the rotation speed of the developing roller disposed at the upstream side of the turning direction of the photoreceptor changes. However, the present invention is not to be limited thus. For example, the rotation speed of the developing roller disposed at the upstream side of the turning direction of the photoreceptor may be changed when a detected fine line density is outside a density range that is specified in advance as a range in which deteriorations in image quality do not occur. For example, if a detected fine line density is higher than the maximum value of the pre-specified density range, the rotation speed of the developing roller disposed at the upstream side of the turning direction of the photoreceptor may be changed so as to speed up, and if a detected fine line density is lower than the minimum value of the pre-specified density range, the rotation speed of the developing roller disposed at the upstream side of the turning direction of the photoreceptor may be changed so as to slow down.

Next, a fifth exemplary embodiment is described. A printer relating to the fifth exemplary embodiment has the same structure as in the first exemplary embodiment, so the same reference numerals are assigned and descriptions are not given.

The fifth exemplary embodiment differs from the first exemplary embodiment in that the developing bias voltage applied to the developing rollers is chosen in accordance with detected density unevenness.

Figure 16:
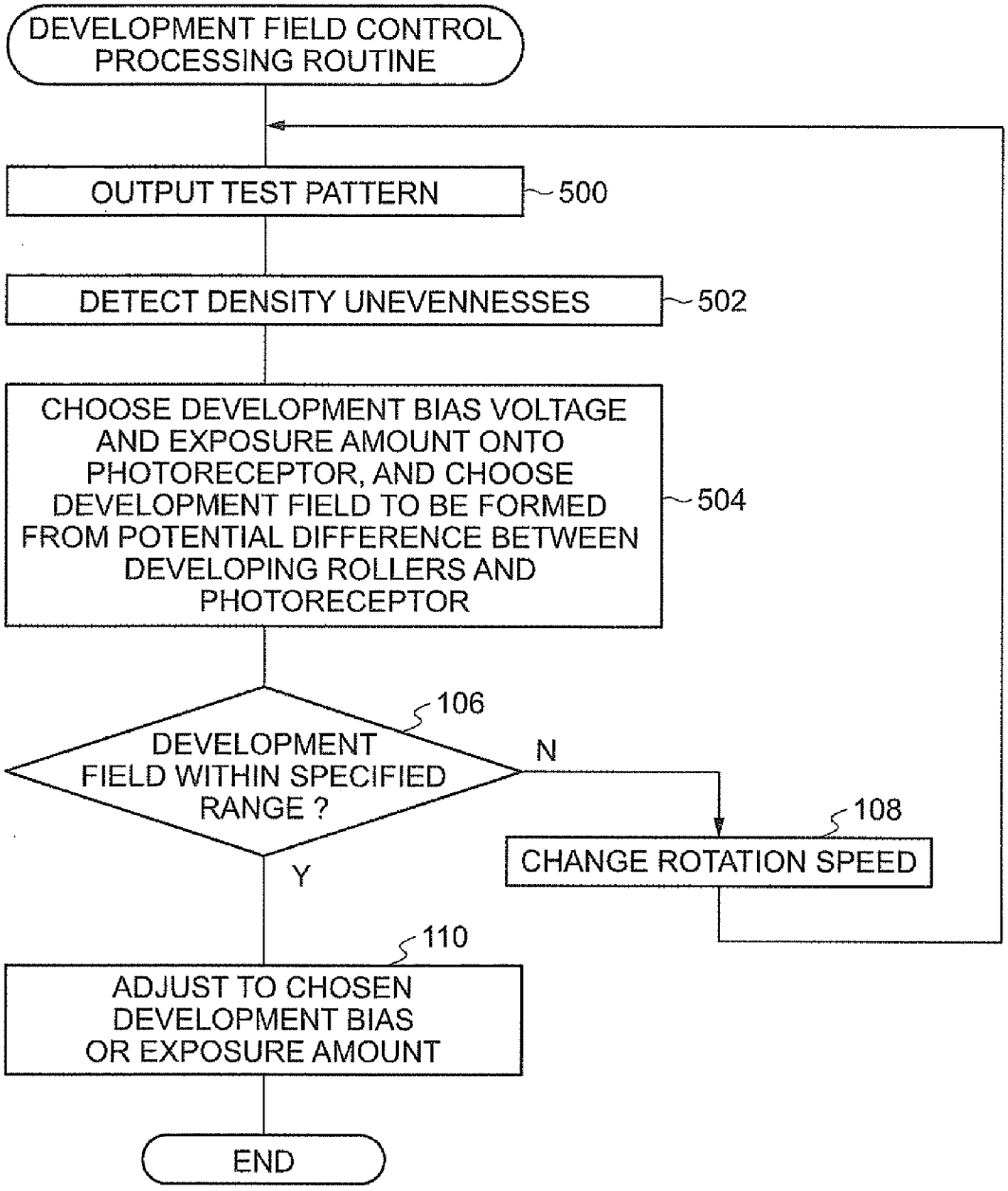
FIG. 16 is a flowchart illustrating details of a development field control processing routine of a control unit relating to a fifth exemplary embodiment of the present invention.

A development field control processing routine relating to the fifth exemplary embodiment is described with reference to FIG. 16. In the following description, a case of performing development field adjustment for cyan is described.

First, in step 500, a cyan test pattern for detecting density unevenness is generated, and a toner image in which the cyan test pattern is developed is formed on the intermediate transfer belt 16 by the image formation control section 162. In step 502, when the developed toner image of the test pattern is conveyed to the reading position of the optical sensor 165, the whole of the test pattern toner image is read by the optical sensor 165, and density unevennesses are detected from reading data based on the test pattern. For example, CIELAB L* values of the test pattern image are calculated for respective pixels, and a maximum value in L* value differences between neighboring pixels is detected to serve as a degree of density unevenness.

Then, in step 504, the developing bias voltage applied to the developing rollers 70A and 70B or the exposure amount onto the photoreceptor 28, or both, is chosen on the basis of the degree of density unevenness detected in step 502, and a development field to be formed between the developing rollers 70A and 70B, and the photoreceptor 28 is chosen. For example, if a detected degree of density unevenness is not within a pre-specified density range, the developing bias voltage and exposure amount are chosen in order to suppress density unevenness.

Then, in step 106, it is determined whether or not the development field chosen in step 504 is within a pre-specified development field range. If it is determined that the development field is outside the pre-specified development field range, then, in step 108, control is performed so as to change the rotation speed of the developing roller 70A, and control returns to step 500. If the chosen development field is larger than the maximum value of the pre-specified development field range, the rotation speed of the developing roller 70A is changed so as to increase. On the other hand, if the chosen development field is smaller than the minimum value of the pre-specified development field range, the rotation speed of the developing roller 70A is changed so as to decrease.

Alternatively, if the development field is determined to be within the pre-specified development field range in step 106, then, in step 110, the developing bias voltage applied to the developing rollers 70A and 70B or the exposure amount onto the photoreceptor 28 is adjusted to the developing bias voltage or exposure amount onto the photoreceptor 28 chosen in step 504, and the development field control processing routine ends. Thus, the developing bias voltage or exposure amount is adjusted such that the development field is formed in accordance with results of detection of density unevenness.

As described hereabove, according to the printer relating to the fifth exemplary embodiment, the rotation speed of the developing roller disposed at the upstream side of the turning direction of the photoreceptor changes in accordance with detected degrees of density unevenness and a development capacity according to the plural developing rollers is adjusted, with a development field with which deteriorations of image quality do not occur being maintained rather than the development field being put outside the development field range in which deteriorations of image quality do not occur.

In the exemplary embodiment described hereabove, an example is described of a case in which, if the development field chosen on the basis of detected density unevenness is outside a pre-specified development field range, the rotation speed of the developing roller disposed at the upstream side of the turning direction of the photoreceptor changes. However, the present invention is not to be limited thus. For example, the rotation speed of the developing roller disposed at the upstream side of the turning direction of the photoreceptor may be changed when a detected degree of density unevenness is outside a range that is specified in advance as a range in which deteriorations in image quality do not occur. For example, if a detected degree of density unevenness is higher than the maximum value of the pre-specified range, the rotation speed of the developing roller disposed at the upstream side of the turning direction of the photoreceptor may be changed so as to slow down, and if a detected degree of density unevenness is lower than the minimum value of the pre-specified range, the rotation speed of the developing roller disposed at the upstream side of the turning direction of the photoreceptor may be changed so as to speed up.

Next, a sixth exemplary embodiment is described. A printer relating to the sixth exemplary embodiment has the same structure as in the first exemplary embodiment, so the same reference numerals are assigned and descriptions are not given.

The sixth exemplary embodiment differs from the first exemplary embodiment in that the developing bias voltage applied to the developing rollers or the exposure amount is chosen in accordance with an amount of toner that is developed over a certain duration.

Figure 17:
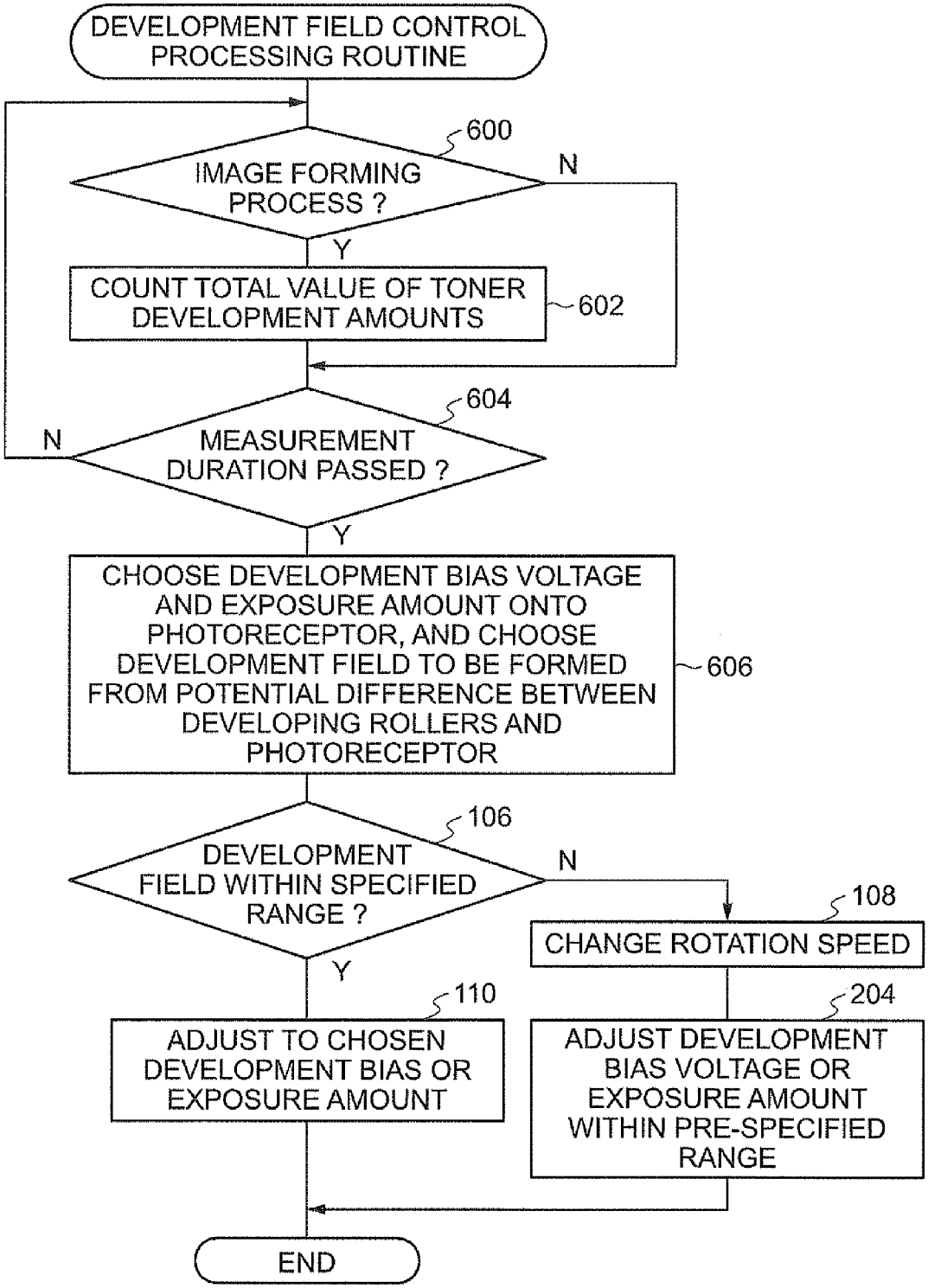
FIG. 17 is a flowchart illustrating details of a development field control processing routine of a control unit relating to a sixth exemplary embodiment of the present invention.

A development field control processing routine relating to the sixth exemplary embodiment is described with reference to FIG. 17. In the following description, a case of performing development field adjustment for cyan is described.

First, in step 600, it is determined whether or not an image forming process has been carried out, and if it is determined that no image forming process has been carried out, control passes to step 604. On the other hand, if it is determined that an image forming process has been carried out, a development amount of toner is calculated on the basis of the image data of the image forming process, and is counted into a total value of toner development amounts.

In step 604, it is determined whether or not a pre-specified measurement duration has passed since the start of execution of the development field control processing routine. If the pre-specified measurement duration has not passed, control returns to step 600. On the other hand, if the pre-specified measurement duration has passed, then, in step 606, the developing bias voltage applied to the developing rollers 70A and 70B or the exposure amount onto the photoreceptor 28, or both, is chosen on the basis of the counted-up total value of toner development amounts, and a development field to be formed between the developing rollers 70A and 70B, and the photoreceptor 28 is chosen. For example, when the total value of toner development amounts is larger, because charge amounts of the toner are lower, a lower developing bias voltage and smaller exposure amount are chosen.

Then, in step 106, it is determined whether or not the development field chosen in step 606 is within a pre-specified development field range. If it is determined that the development field is outside the pre-specified development field range, then, in step 108, control is performed so as to change the rotation speed of the developing roller 70A. If the chosen development field is larger than the maximum value of the pre-specified development field range, the rotation speed of the developing roller 70A is changed so as to increase. On the other hand, if the chosen development field is smaller than the minimum value of the pre-specified development field range, the rotation speed of the developing roller 70A is changed so as to decrease.

In step 204, the developing bias voltage applied to the developing rollers 70A and 70B or the exposure amount onto the photoreceptor 28 is adjusted within a pre-specified voltage range or pre-specified exposure amount range corresponding to the pre-specified development field range, and the development field control processing routine ends.

Alternatively, if the development field is determined to be within the pre-specified development field range in step 106, then, in step 110, the developing bias voltage applied to the developing rollers 70A and 70B or the exposure amount onto the photoreceptor 28 is adjusted to the developing bias voltage or exposure amount onto the photoreceptor 28 chosen in step 606, and the development field control processing routine ends. Thus, the developing bias voltage or exposure amount is adjusted such that the development field is formed in accordance with the total value of toner development amounts over the pre-specified duration.

As described hereabove, according to the printer relating to the sixth exemplary embodiment, the rotation speed of the developing roller disposed at the upstream side of the turning direction of the photoreceptor changes in accordance with total values of toner development amounts over the pre-specified duration and a development capacity according to the plural developing rollers is adjusted, with a development field with which deteriorations of image quality do not occur being maintained rather than the development field being put outside the development field range in which deteriorations of image quality do not occur.

In the exemplary embodiment described hereabove, an example is described of a case in which, if the development field chosen on the basis of a counted-up total value of toner development amounts is outside a pre-specified development field range, the rotation speed of the developing roller disposed at the upstream side of the turning direction of the photoreceptor changes. However, the present invention is not to be limited thus. For example, the rotation speed of the developing roller disposed at the upstream side of the turning direction of the photoreceptor may be changed when a counted-up total value of toner development amounts is outside a range that is specified in advance as a range in which deteriorations in image quality do not occur. For example, if a counted-up total value of toner development amounts is higher than the maximum value of the pre-specified range, the rotation speed of the developing roller disposed at the upstream side of the turning direction of the photoreceptor may be changed so as to speed up, and if a counted-up total value of toner development amounts is lower than the minimum value of the pre-specified range, the rotation speed of the developing roller disposed at the upstream side of the turning direction of the photoreceptor may be changed so as to slow down.

Next, a seventh exemplary embodiment is described. Portions with the same structure as in the first exemplary embodiment are assigned the same reference numerals and are not described.

The seventh exemplary embodiment differs from the first exemplary embodiment in that the developing bias voltage applied to the developing rollers is chosen in accordance with electrostatic charge amounts of the toner.

Figure 18:
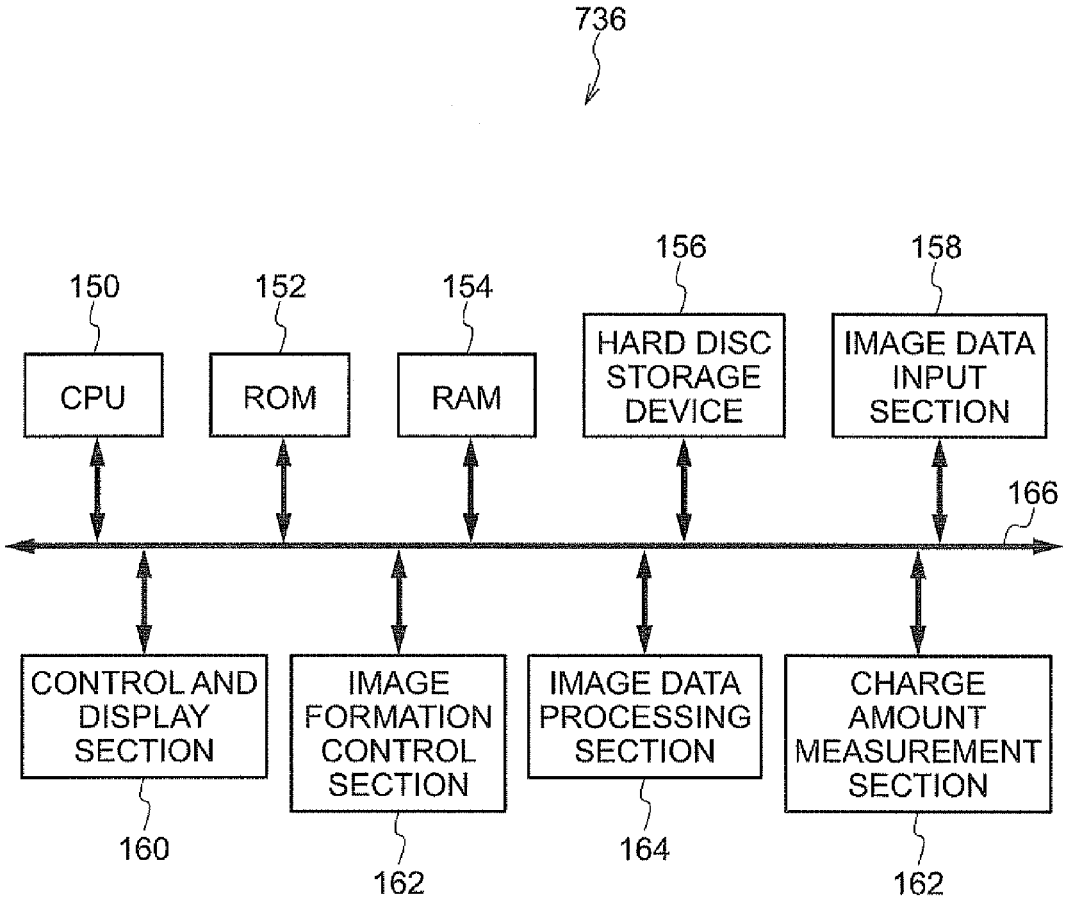
FIG. 18 is a block diagram illustrating structure of a control unit relating to a seventh exemplary embodiment of the present invention.

As illustrated in FIG. 18, in a control unit 736 of a printer relating to the seventh exemplary embodiment, the CPU 150 is connected with each of the ROM 152, the RAM 154, the hard disc storage device 156, the image data input section 158, the control and display section 160, the image formation control section 162, the image data processing section 164 and a charge amount measurement section 765, via the bus 166.

The charge amount measurement section 765 is constituted using a sensor provided at the agitation and conveyance path 84A or the agitation and conveyance path 84B of the developing section 70 of the image forming unit 12, and measures charge amounts of the developer.

Other structures of the printer relating to the seventh exemplary embodiment are the same as in the first exemplary embodiment, so will not be described.

Figure 19:
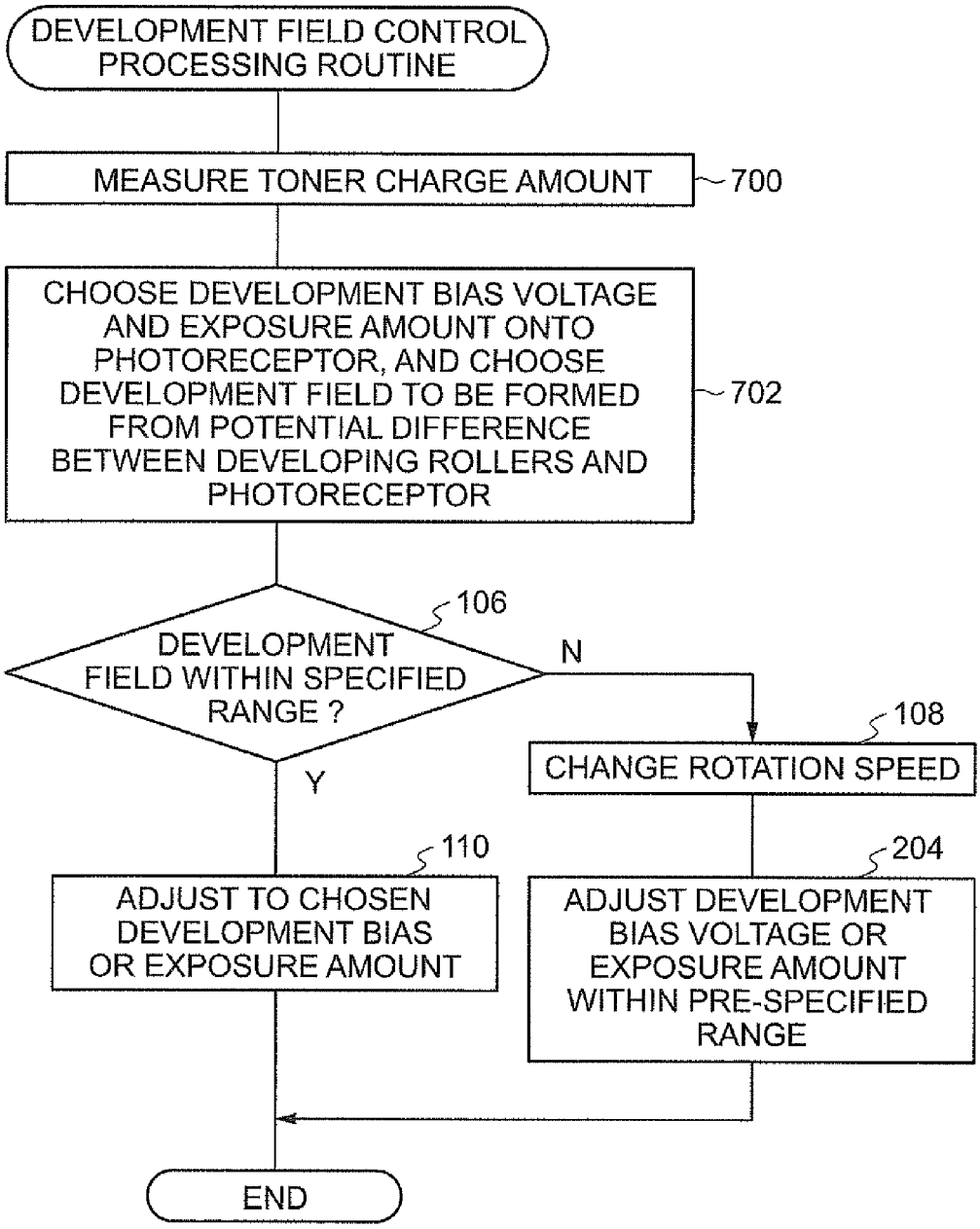
FIG. 19 is a flowchart illustrating details of a development field control processing routine of the control unit relating to the seventh exemplary embodiment of the present invention.

Next, a development field control processing routine relating to the seventh exemplary embodiment is described with reference to FIG. 19. In the following description, a case of performing development field adjustment for cyan is described.

First, in step 700, a toner charge amount is measured by the corresponding charge amount measurement section 765. Then, in step 702, the developing bias voltage applied to the developing rollers 70A and 70B or the exposure amount onto the photoreceptor 28, or both, is chosen on the basis of the charge amount measured in step 700, and the development field formed between the developing rollers 70A and 70B, and the photoreceptor 28 is chosen. For example, when the measured toner charge amount is larger, a higher developing bias voltage and a larger exposure amount are chosen.

Then, in step 106, it is determined whether or not the development field chosen in step 702 is within a pre-specified development field range. If it is determined that the development field is outside the pre-specified electric field range, then, in step 108, control is performed so as to change the rotation speed of the developing roller 70A.

In step 204, the developing bias voltage applied to the developing rollers 70A and 70B or the exposure amount onto the photoreceptor 28 is adjusted within a pre-specified voltage range or pre-specified exposure amount range corresponding to the pre-specified development field range, and the development field control processing routine ends.

Alternatively, if the development field is determined to be within the pre-specified electric field range in step 106, then, in step 110, the developing bias voltage applied to the developing rollers 70A and 70B or the exposure amount onto the photoreceptor 28 is adjusted to the developing bias voltage or exposure amount onto the photoreceptor 28 chosen in step 702, and the development field control processing routine ends. Thus, the developing bias voltage or exposure amount is adjusted such that the development field is formed in accordance with the toner charge amount.

As described hereabove, according to the printer relating to the seventh exemplary embodiment, the rotation speed of the developing roller disposed at the upstream side of the turning direction of the photoreceptor changes in accordance with measured toner charge amounts and a development capacity according to the plural developing rollers is adjusted, with a development field with which deteriorations of image quality do not occur being maintained rather than the development field being put outside the development field range in which deteriorations of image quality do not occur.

In the exemplary embodiment described hereabove, an example is described of a case in which, if the development field chosen on the basis of measured toner charge amounts is outside a pre-specified electric field range, the rotation speed of the developing roller disposed at the upstream side of the turning direction of the photoreceptor is changed. However, the present invention is not to be limited thus. For example, the rotation speed of the developing roller disposed at the upstream side of the turning direction of the photoreceptor may be changed when a measured toner charge amount is outside a range that is specified in advance as a range in which deteriorations in image quality do not occur. For example, if a measured toner charge amount is higher than the maximum value of the pre-specified range, the rotation speed of the developing roller disposed at the upstream side of the turning direction of the photoreceptor may be changed so as to speed up, and if a measured toner charge amount is lower than the minimum value of the pre-specified range, the rotation speed of the developing roller disposed at the upstream side of the turning direction of the photoreceptor may be changed so as to slow down.

Rather than toner charge amounts being directly measured using a sensor, toner charge amounts may be measured from other information, such as image data or the like.

Next, an eighth exemplary embodiment is described. Portions with the same structure as in the first exemplary embodiment are assigned the same reference numerals and are not described.

The eighth exemplary embodiment differs from the first exemplary embodiment in that the developing section has a configuration in which developer is transferred from one developing roller to the other developing roller.

Figure 20:
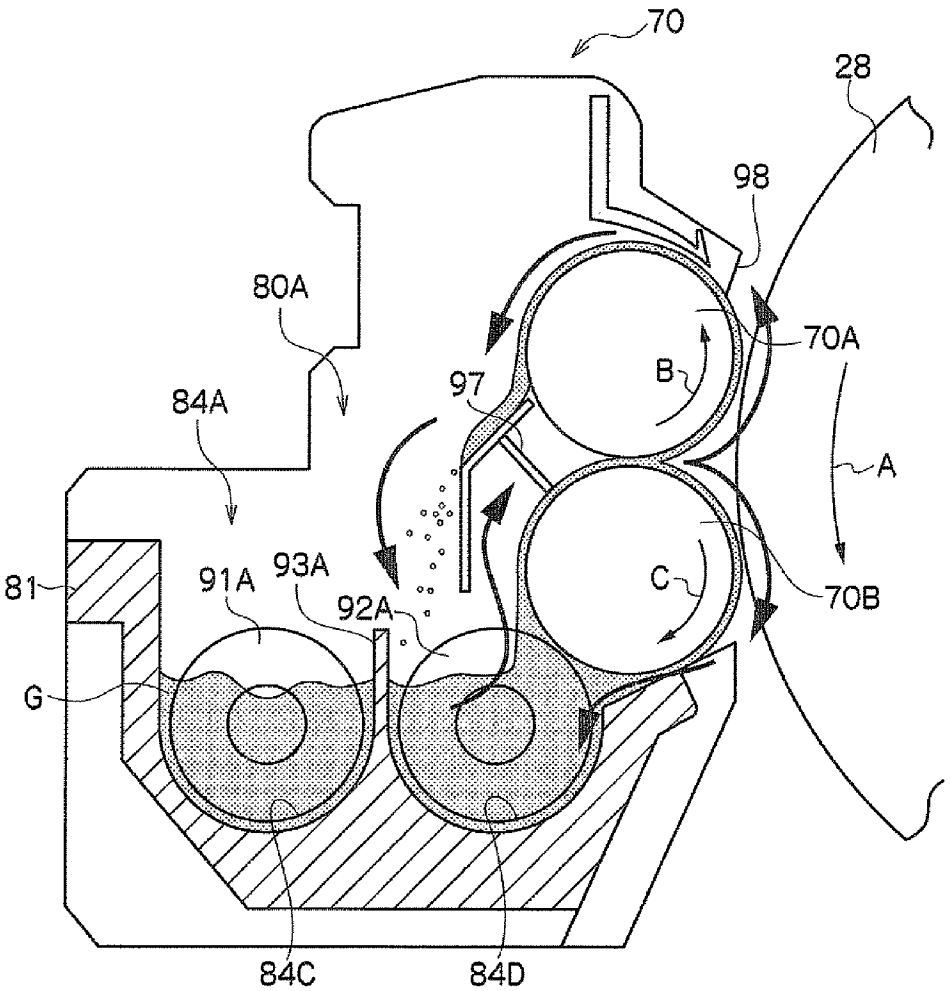
FIG. 20 is a sectional diagram of a developing section of a printer relating to an eighth exemplary embodiment of the present invention.

As illustrated in FIG. 20, the developing section 70 of a printer relating to the eighth exemplary embodiment is provided with the casing 81 inside which the developer accommodation chamber 80A that accommodates the developer G is formed. As illustrated in FIG. 20, the agitation and conveyance path 84A that agitates (mixes) and conveys the developer G is formed in the developer accommodation chamber 80A.

The agitation and conveyance path 84A is partitioned by the partition wall 93A provided standing from a bottom face and two agitation paths are formed, the first agitation path 84C and the second agitation path 84D.

The regulation roller 97 is disposed at the periphery of the developing roller 70B.

The regulation roller 97 is disposed at a spacing from the outer peripheral face of the developing roller 70B. The regulation roller 97 regulates amounts of developer passing along the surface of the developing roller 70B, and forms a developer layer of a pre-decided thickness on the surface of the developing roller 70B.

The developing roller 70B transfers a portion of the developer in the developer layer to the developing roller 70A, retains developer remaining in the developer layer, and performs development. The developing roller 70A forms the transferred developer into a thin layer, retains the developer, and performs development. After development, both of the developing rollers 70A and 70B return the developer to the first agitation path 84C and the second agitation path 84D.

The above-described development field control processing routines of the first exemplary embodiment to the seventh exemplary embodiment may be executed in combination.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a plurality of developer retaining bodies that retain developer and rotate, and that respectively convey the developer, which is supplied to each of the developer retaining bodies from a developer supply section, to an image bearing body that rotates and bears a latent image; and a speed changing unit that is adapted to change a rotation speed of at least one of the developer retaining bodies excluding a developer retaining body that is furthest downstream side in a direction of rotation of the image bearing body, without changing the rotation speed of the developer retaining body that is furthest downstream side in the direction of rotation of the image bearing body.

2. The developing device according to claim 1, wherein the at least one developer retaining body supplies a portion of the developer supplied from the developer supply section to another of the developer retaining bodies, and retains a remainder of the developer.

3. A developing device comprising:

a plurality of developer retaining bodies that retain developer and rotate, and that respectively convey the developer, which is supplied to each of the developer retaining bodies from a developer supply section, to an image bearing body that rotates and bears a latent image;

a speed changing unit that is adapted to change a rotation speed of at least one of the developer retaining bodies excluding a developer retaining body that is furthest downstream side n a direction of rotation of the image bearing body; and a development field control unit that controls a development field that is generated by a potential difference between the image bearing body and the developer retaining bodies, wherein, if the development field formed between the developer retaining bodies and the image bearing body by the development field control unit is outside a pre-specified range, the speed changing unit changes the rotation speed of the at least one developer retaining body.

4. The developing device according to claim 1, further comprising a density detection unit that detects the density of a toner image into which the latent image of the image bearing body is developed by conveyance of the developer by the developer retaining bodies, or the density of the toner image after the toner image has been transferred onto a transfer-receiving body, wherein, if the density of the toner image detected by the density detection unit is outside a pre-specified range, the speed changing unit changes the rotation speed of the at least one developer retaining body.

5. The developing device according to claim 1, further comprising:

a humidity detection unit that detects humidity; and a development field control unit that, on the basis of the humidity detected by the humidity detection unit, controls a development field that is generated by a potential difference between the image bearing body and the developer retaining bodies, using at least one of an exposure amount applied to the image bearing body or a voltage applied to the developer retaining bodies, wherein, if the development field formed between the developer retaining bodies and the image bearing body by the development field control unit is outside a pre-specified range, the speed changing unit changes the rotation speed of the at least one developer retaining body.

6. The developing device according to claim 1, further comprising a humidity detection unit that detects humidity, wherein, if the humidity detected by the humidity detection unit is outside a pre-specified range, the speed changing unit changes the rotation speed of the at least one developer retaining body.

7. The developing device according to claim 1, further comprising:

a white spot detection unit that detects white spots from a toner image when a latent image of the image bearing body that has been pre-specified for detection of white spots is developed by conveyance of the developer by the developer retaining bodies, or from the toner image after the toner image has been transferred onto a transfer-receiving body; and a development field control unit that, on the basis of the white spots detected by the white spot detection unit, controls a development field that is generated by a potential difference between the image bearing body and the developer retaining bodies, using at least one of an exposure amount applied to the image bearing body or a voltage applied to the developer retaining bodies, wherein, if the development field formed between the developer retaining bodies and the image bearing body by the development field control unit is outside a pre-specified range, the speed changing unit changes the rotation speed of the at least one developer retaining body.

8. The developing device according to claim 1, further comprising a white spot detection unit that detects white spots from a toner image when a latent image of the image bearing body that has been pre-specified for detection of white spots is developed by conveyance of the developer by the developer retaining bodies, or from the toner image after the toner image has been transferred onto a transfer-receiving body, wherein, if a number of the white spots detected by the white spot detection unit is outside a pre-specified range, the speed changing unit changes the rotation speed of the at least one developer retaining body.

9. The developing device according to claim 1, further comprising:

a line density detection unit that detects line density from a toner image when a latent image of the image bearing body that has been pre-specified for detection of line density is developed by conveyance of the developer by the developer retaining bodies, or from the toner image after the toner image has been transferred onto a transfer-receiving body; and a development field control unit that, on the basis of the line density detected by the line density detection unit, controls a development field that is generated by a potential difference between the image bearing body and the developer retaining bodies, using at least one of an exposure amount applied to the image bearing body or a voltage applied to the developer retaining bodies, wherein, if the development field formed between the developer retaining bodies and the image bearing body by the development field control unit is outside a pre-specified range, the speed changing unit changes the rotation speed of the at least one developer retaining body.

10. The developing device according to claim 1, further comprising a line density detection unit that detects line density from a toner image when a latent image of the image bearing body that has been pre-specified for detection of line density is developed by conveyance of the developer by the developer retaining bodies, or from the toner image after the toner image has been transferred onto a transfer-receiving body, wherein, if the line density detected by the line density detection unit is outside a pre-specified range, the speed changing unit changes the rotation speed of the at least one developer retaining body.

11. The developing device according to claim 1, further comprising:

a density unevenness detection unit that detects density unevenness from a toner image when a latent image of the image bearing body that has been pre-specified for detection of density unevenness is developed by conveyance of the developer by the developer retaining bodies, or from the toner image after the toner image has been transferred onto a transfer-receiving body; and a development field control unit that, on the basis of the density unevenness detected by the density unevenness detection unit, controls a development field that is generated by a potential difference between the image bearing body and the developer retaining bodies, using at least one of an exposure amount applied to the image bearing body or a voltage applied to the developer retaining bodies, wherein, if the development field formed between the developer retaining bodies and the image bearing body by the development field control unit is outside a pre-specified range, the speed changing unit changes the rotation speed of the at least one developer retaining body.

12. The developing device according to claim 1, further comprising a density unevenness detection unit that detects density unevenness from a toner image when a latent image of the image bearing body that has been pre-specified for detecting density unevenness is developed by conveyance of the developer by the developer retaining bodies, or from the toner image after the toner image has been transferred onto a transfer-receiving body, wherein, if a degree of the density unevenness detected by the density unevenness detection unit is outside a pre-specified range, the speed changing unit changes the rotation speed of the at least one developer retaining body.

13. The developing device according to claim 1, further comprising:

a developer amount calculation unit that calculates a total amount of the developer during a pre-specified time period when a pre-specified latent image of the image bearing body is developed by conveyance of the developer by the developer retaining bodies; and a development field control unit that, on the basis of the total amount of the developer calculated by the developer amount calculation unit, controls a development field that is generated by a potential difference between the image bearing body and the developer retaining bodies, using at least one of an exposure amount applied to the image bearing body or a voltage applied to the developer retaining bodies, wherein, if the development field formed between the developer retaining bodies and the image bearing body by the development field control unit is outside a pre-specified range, the speed changing unit changes the rotation speed of the at least one developer retaining body.

14. The developing device according to claim 1, further comprising a developer amount calculation unit that calculates a total amount of the developer during a pre-specified time period when a pre-specified latent image of the image bearing body is developed by conveyance of the developer by the developer retaining bodies, wherein, if the total amount of developer calculated by the developer amount calculation unit is outside a pre-specified range, the speed changing unit changes the rotation speed of the at least one developer retaining body.

15. The developing device according to claim 1, further comprising:

a charge amount detection unit that detects a charge amount of the developer supplied from the developer supply section, the developer including at least a carrier; and a development field control unit that, on the basis of the charge amount detected by the charge amount detection unit, controls a development field that is generated by a potential difference between the image bearing body and the developer retaining bodies, using at least one of an exposure amount applied to the image bearing body or a voltage applied to the developer retaining bodies, wherein, if the development field formed between the developer retaining bodies and the image bearing body by the development field control unit is outside a pre-specified range, the speed changing unit changes the rotation speed of the at least one developer retaining body.

16. The developing device according to claim 1, further comprising a charge amount detection unit that detects a charge amount of the developer supplied from the developer supply section, the developer including at least a carrier, wherein, if the charge amount detected by the charge amount detection unit is outside a pre-specified range, the speed changing unit changes the rotation speed of the at least one developer retaining body.

17. An image forming device comprising:

the developing device according to claim 1; and the image bearing body, at which a latent image formed on a surface is developed by the developer of the developing device.

18. A developing device comprising:

a plurality of developer retaining bodies that retain developer and rotate, and that respectively convey the developer, which is supplied to each of the developer retaining bodies from a developer supply section, to an image bearing body that rotates and bears a latent image;

a speed changing unit that is adapted to change a rotation speed of at least one of the developer retaining bodies excluding a developer retaining body that is furthest downstream side in a direction of rotation of the image bearing body; and an exposure control unit that controls an exposure amount applied to the image bearing body, wherein, if the exposure amount applied to the image bearing body is outside a pre-specified range, the speed changing unit changes the rotation speed of the at least one developer retaining body.

19. A developing device comprising:

a plurality of developer retaining bodies that retain developer and rotate, and that respectively convey the developer, which is supplied to each of the developer retaining bodies from a developer supply section, to an image bearing body that rotates and bears a latent image;

a speed changing unit that is adapted to change a rotation speed of at least one of the developer retaining bodies excluding a developer retaining body that is furthest downstream side in a direction of rotation of the image bearing body; and a voltage control unit that controls a voltage applied to the developer retaining bodies, wherein, if the voltage applied to the developer retaining bodies is outside a pre-specified range, the speed changing unit changes the rotation speed of the at least one developer retaining body.

20. A developing device comprising:

a plurality of developer retaining bodies that retain developer and rotate, and that respectively convey the developer, which is supplied to each of the developer retaining bodies from a developer supply section, to an image bearing body that rotates and bears a latent image;

a speed changing unit that is adapted to change a rotation speed of at least one of the developer retaining bodies excluding a developer retaining body that is furthest downstream side in a direction of rotation of the image bearing body; and a density detection unit that detects the density of a toner image into which the latent image of the image bearing body is developed by conveyance of the developer by the developer retaining bodies, or the density of the toner image after the toner image has been transferred onto a transfer-receiving body, wherein, if the density of the toner image detected by the density detection unit is outside a pre-specified range, the speed changing unit changes the rotation speed of the at least one developer retaining body.

21. A developing device comprising:

a plurality of developer retaining bodies that retain developer and rotate, and that respectively convey the developer, which is supplied to each of the developer retaining bodies from a developer supply section, to an image bearing body that rotates and bears a latent image;

a speed changing unit that is adapted to change a rotation speed of at least one of the developer retaining bodies excluding a developer retaining body that is furthest downstream side in a direction of rotation of the image bearing body; and a humidity detection unit that detects humidity, wherein, if the humidity detected by the humidity detection unit is outside a pre-specified range, the speed changing unit changes the rotation speed of the at least one developer retaining body.

* * * * *